United States Patent [19]

Kato et al.

[11] Patent Number: 5,077,165

[45] Date of Patent: Dec. 31, 1991

[54] ELECTROPHOTOGRAPHIC LITHOGRAPHIC PRINTING PLATE PRECURSOR

[75] Inventors: Eiichi Kato; Kazuo Ishii, both of Shizuoka, Japan

[73] Assignee: Fuji Photo Film Co., Ltd., Kanagawa, Japan

[21] Appl. No.: 538,053

[22] Filed: Jun. 13, 1990

[30] Foreign Application Priority Data

Jun. 13, 1989 [JP] Japan ..... 1-148256

[51] Int. Cl.[5] ..... G03G 5/087; G03G 5/09

[52] U.S. Cl. ..... 430/89; 430/49; 430/96

[58] Field of Search ..... 430/49, 96, 89

[56] References Cited

U.S. PATENT DOCUMENTS 4,929,526 5/1990 Kato et al. ..... 430/49 X
4,968,572 11/1990 Kato et al. ..... 430/96
4,971,870 11/1990 Kato et al. ..... 430/49
4,977,049 12/1990 Kato ..... 430/96 X

FOREIGN PATENT DOCUMENTS 0307227 3/1989 European Pat. Off. ..... 430/96

*Primary Examiner*—Roland Martin
*Attorney, Agent, or Firm*—Sughrue, Mion, Zinn, Macpeak & Seas

[57] ABSTRACT

A lithographic printing plate precursor excellent in oil-desensitivity, whereby an original is faithfully reproduced without occurrence of overall or spotted stains as an offset master is provided, which comprises an electrically conductive support and at least one photoconductive layer, provided thereon, containing photoconductive zinc oxide and a binder resin, in which said photoconductive layer contains hydrophilic resin grains having an average grain diameter of same as or smaller than the maximum grain diameter of said photoconductive zinc oxide grains, and said binder resin contains at least one of Resin A having a weight average molecular weight of $1\times10^3$ to $2\times10^4$ and Resin B having a weight average molecular weight of at least $3\times10^4$.

16 Claims, No Drawings

ELECTROPHOTOGRAPHIC LITHOGRAPHIC PRINTING PLATE PRECURSOR

BACKGROUND OF THE INVENTION

1. Field of the Invention

This invention relates to an electrophotographic lithographic printing plate precursor made by an electrophotographic system and more particularly, it is concerned with an improvement in a photoconductive layer forming composition for the lithographic printing plate precursor.

2. Description of the Prior Art

A number of offset masters for directly producing printing plates have hitherto been proposed and some of them have already been put into practical use. Widely employed among them is a system in which a photoreceptor comprising a conductive support having provided thereon a photoconductive layer mainly comprising photoconductive particles, for example, of zinc oxide and a resin binder is subjected to an ordinary electrophotographic processing to form a highly lipophilic toner image on the surface of the photoreceptor, followed by treating the surface with an oil-desensitizing solution referred to as an etching solution to selectively render non-image areas hydrophilic and thus obtain an offset printing plate.

Requirements of offset masters for obtaining satisfactory prints include: (1) an original should be reproduced faithfully on the photoreceptor; (2) the surface of the photoreceptor has affinity with an oil-desensitizing solution so as to render non-image areas sufficiently hydrophilic, but, at the same time, has resistance to solubilization; and (3) a photoconductive layer having an image formed thereon is not released during printing and is well receptive to dampening water so that the non-image areas retain the hydrophilic properties sufficiently to be free from stains even upon printing a large number of prints.

It is known that these properties are affected by the ratio of zinc oxide to a resin binder in the photoconductive layer. For example, if the ratio of a binder resin to zinc oxide particles is decreased, oil-desensitivity of the surface of the photoconductive layer is increased to reduce background stains, but, on the other hand, the internal cohesion of the photoconductive layer per se is weakened, resulting in reduction of printing durability due to insufficient mechanical strength. If the ratio of a binder resin to zinc oxide particles is increased, on the other hand, printing durability is improved, but background staining becomes conspicuous. It is a matter of course that the background staining is a phenomenon associated with the degree of oil-desensitization achieved and it has been made apparent that the oil-desensitization of the photoconductive layer surface depends on not only the binder resin/zinc oxide ratio in the photoconductive layer, but also the kind of the binder resin used to a great extent.

For particular use as an offset master, occurrence of background stains due to insufficient oil-desensitivity presents a serious problem. In order to solve this problem, various resins for binding zinc oxide have been proposed to improve the oil-desensitization, including resins of weight average molecular weight ($\overline{M}w$) $1.8\text{-}10\times10^{-4}$ and glass transition point (Tg) 10°-80° C. obtained by copolymerizing (meth)acrylate monomers and other monomers in the presence of fumaric acid in combination with copolymers of (meth)acrylate monomers and other monomers than fumaric acid, as disclosed in Japanese Patent Publication No. 31011/1975; terpolymers each containing a (meth)acrylic acid ester unit having a substituent having carboxylic acid group at least 7 atoms distant from the ester linkage, as disclosed in Japanese Patent Laid-Open Publication No. 54027/1978; tetra- or pentamers each containing an acrylic acid unit and hydroxyethyl (meth)acrylate unit, as disclosed in Japanese Patent Laid-Open Publication Nos. 20735/1979 and 202544/1982; terpolymers each containing a (meth)acrylic acid ester unit having an alkyl group having 6 to 12 carbon atoms as a substituent and a vinyl monomer containing carboxylic acid group, as disclosed in Japanese Patent Laid-Open Publication No. 046/1983; and the like. These resins function to improve the oil-desensitivity of photoconductive layers.

Nevertheless, evaluation of such resins as noted above for improving the oil-desensitization indicate that none of them is completely satisfactory in terms of stain resistance, printing durability and the like.

Furthermore, it has hitherto been studied to use resins having functional groups capable of forming hydrophilic groups through decomposition as such a binder resin, for example, those having functional groups capable of forming hydroxyl groups as disclosed in Japanese Patent Laid-Open Publication Nos. 195684/1987, 210475/1987 and 210476/1987 and those having functional groups capable of forming carboxyl groups as disclosed in Japanese Patent Laid-Open Publication No. 12669/1987.

These resins are those which form hydrophilic groups through hydrolysis or hydrogenolysis with an oil-desensitizing solution or dampening water used during printing. When using them as a binder resin for a lithographic printing plate precursor, it is possible to avoid various problems, e.g., deterioration of smoothness, deterioration of electrophotographic properties such as dark charge retention and photosensitivity, etc., which are considered to be caused by strong interaction of the hydrophilic groups and surfaces of photoconductive zinc oxide particles in the case of using resins intrinsically having hydrophilic groups per se, and at the same time, a number of prints with clear image quality and without background stains can be obtained, since the hydrophilic property of non-image areas rendered hydrophilic with an oil-desensitizing solution is further increased by the above described hydrophilic groups formed through decomposition in the resin to make clear the lipophilic property of image areas and the hydrophilic property of non-image areas and to prevent the non-image areas from adhesion of a printing ink during printing.

At the present time, in the electrophotographic lithographic printing, a higher efficiency has been required and in particular, it has been required to increase the speeds of plate making and etching and to obtain a print with a clear image quality, particularly free from background stains, from the start of printing, thus reducing loss of prints.

In the scanning exposing system using a semiconductor laser beam, furthermore, higher performances are required for static properties, in particular, dark charge retension and photosensitivity, since the exposing time is longer and the exposing intensity is more restricted than in the overall and simultaneously exposing system of the prior art using visible rays.

For such requirements is insufficient the above proposed offset printing plate using the binder resin capable of forming hydrophilic groups through decomposition with respect to the problems of increasing the etching speed and reducing the loss of prints.

SUMMARY OF THE INVENTION

It is an object of the present invention to provide an electrophotographic lithographic printing plate precursor, whereby the disadvantages of the prior art, as described above, can be overcome.

It is another object of the present invention to provide a lithographic printing plate precursor excellent in oil-desensitivity, as well as static properties, in particular, dark charge retention and photosensitivity, whereby an original is faithfully reproduced without occurrence of overall or spotted stains as an offset master.

It is a further object of the present invention to provide a lithographic printing plate with a clear and good quality image even if the ambient conditions during forming a reproduced image are fluctuated from low temperature and low humidity to high temperature and high humidity.

It is a still further object of the present invention to provide a lithographic printing plate precursor with a high printing durability, high printing durability, in which the hydrophilic property of non-image areas is sufficiently held to prevent occurrence of background stains even if the steps of from etching to printing are speeded up.

It is a still further object of the present invention to provide a CPC photoreceptor with excellent static properties and small dependence on the ambient conditions.

It is a still further object of the present invention to provide a lithographic printing plate precursor which is hardly affected by the kind of sensitizing dyes to be jointly used.

These objects can be attained by an electrophotographic lithographic printing plate precursor comprising a conductive support and at least one photoconductive layer, provided thereon, containing photoconductive zinc oxide and a binder resin, wherein said photoconductive layer contains hydrophilic resin grains having an average grain diameter of same as or smaller than the maximum grain diameter of said photoconductive zinc oxide grains and said binder resin contains at least one of the following Resin A and Resin B:

Resin A

A resin having a weight average molecular weight of $1\times10^3$ to $2\times10^4$, containing at least 30% by weight of recurring units represented by the following general formula (I) as polymeric components and having at least one polar group bonded to one end of the polymer main chain, selected from the group consisting of $-PO_3H_2$, $-SO_3H$, $-COOH$, $-OH$,

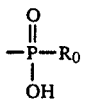

wherein $R_0$ is a hydrocarbon group or $-OR_0'$ ($R_0'$: hydrocarbon group) and cyclic acid anhydride-containing groups:

General Formula (I)

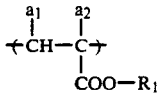

in which $a_1$ and $a_2$ each represent, same or different, hydrogen atom, halogen atoms, cyano group and hydrocarbon groups and $R_1$ represents a hydrocarbon group.

Resin B

A resin consisting of a copolymer having a weight average molecular weight of at least $3\times10^4$ and obtained from a monofunctional macromonomer having a polymerizable double bond group represented by the following general formula (IIc), bonded to only one end of a polymer main chain containing at least one of recurring units represented by the following general formulae (IIa) and (IIb) as polymeric components and having a weight average molecular weight of at most $2\times10^4$ and a monomer represented by the following general formula (III):

General Formula (IIa)

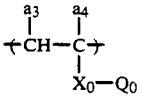

in which $X_0$ represents —COO—, —OCO—, $-(CH_2)_l-OCO-$, $-(CH_2)_l-COO-$, —O—, —CONHCOO—, —CONHCONH—, $-SO_2-$, —CO—,

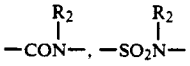

wherein $R_2$ represents hydrogen atom or hydrocarbon group or

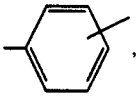

l being an integer of 1 to 3, $Q_0$ represents an aliphatic group containing 1 to 18 carbon atoms or an aromatic group containing 6 to 12 carbon atoms and $a_3$ and $a_4$ each have, same or different, the same meanings as $a_1$ and $a_2$.

General Formula (IIb)

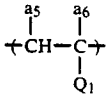

in which $Q_1$ represents —CN, $-CONH_2$ or

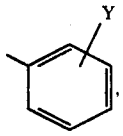

Y represents hydrogen atom, halogen atom, alkoxy group or —$COOZ_0$ wherein $Z_0$ represents an alkyl group, aralkyl group or aryl group, and $a_5$ and $a_6$ each have, same or different, the same meanings as $a_1$ and $a_2$ of General Formula (I).

General Formula (IIc)

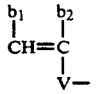

in which V represents the same meaning as $X_0$ in General Formula ($II_a$), $b_1$ and $b_2$ each represents, same or different, hydrogen atom, halogen atoms, cyano group, hydrocarbon groups, —$COOR_3$ or —$COOR_3$ via hydrocarbon groups wherein $R_3$ represents hydrogen atom or an optionally substituted hydrocarbon group.

General Formula (III)

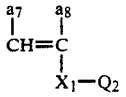

in which $X_1$ has the same meaning as $X_0$ in General Formula (IIa) or V in General Formula (IIc), $Q_2$ has the same meaning as $Q_0$ in General Formula (IIa) and $a_7$ and $a_8$ each have, same or different, the same meanings as $a_1$ and $a_2$ in General Formula (I).

DETAILED DESCRIPTION OF THE INVENTION

In the present invention, the above described Resin A may contain, as the recurring unit represented by General Formula (I), aryl group-containing methacrylate components represented by the following General Formulae (Ia) and/or (Ib).

General Formula (Ia)

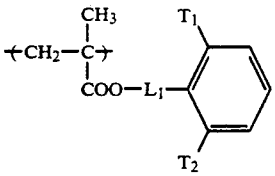

General Formula (Ib)

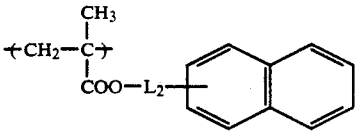

in which $T_1$ and $T_2$ each represent independently hydrogen atom, hydrocarbon groups containing 1 to 10 carbon atoms, chlorine atom, bromine atom, —$COR_4$ or —$COOR_4$ wherein $R_4$ represents a hydrocarbon group containing 1 to 10 carbon atoms, $T_1$ and $T_2$ being not hydrogen atom at the same time, and $L_1$ and $L_2$ each represents direct bonds for bonding —COO— and benzene ring or bonding groups containing 1 to 4 bonding atoms.

In the present invention, the above described Resin B may be a resin consisting of a copolymer obtained from at least a monofunctional macromonomer having a polymerizable double bond group represented by General Formula (IIc), bonded to only one end of a polymer main chain containing at least one of polymeric components represented by General Formulae (IIa) and (IIb) and having a weight average molecular weight of at most $2\times10^4$ and a monomer represented by General Formula (III), and having at least one polar group selected from the group consisting of —$PO_3H_2$, —$SO_3H$, —COOH, —OH, —SH,

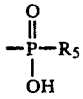

wherein $R_5$ represents a hydrocarbon group or —$OR_5'$ ($R_5'$ represents a hydrocarbon group), cyclic acid anhydride-containing groups, —CHO, —$CONH_2$, —$SO_2NH_2$ and

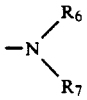

wherein $R_6$ and $R_7$ each represents, same or different, hydrogen atom or hydrocarbon groups, bonded to only one end of at least one polymer main chain.

The hydrophilic resin used in the present invention includes resins such as having a higher order network structure and such that the grain has the above described average grain diameter and the film formed by dissolving the resin grains in a suitable solvent and then coating has a contact angle with distilled water of 50 degrees or less, preferably 30 degrees or less, measured by a goniometer.

In the present invention, it is important that the hydrophilic resin is dispersed in the photoconductive layer in the form of grains whose average grain diameter is same as or smaller than the maximum grain diameter of the photoconductive zinc oxide grains. Such hydrophilic resin grains have such smaller specific areas and less interaction with zinc oxide grain surfaces than those present under molecular state that a lithographic printing plate can be given capable of exhibiting good printing properties because of less deterioration of electrophotographic properties. If there are resin grains having larger grain diameters than zinc oxide grains, the electrophotographic properties are deteriorated and in particular, uniform electrification cannot be obtained, thus resulting in density unevenness in an image area, disappearance of letters or fine lines and background staining in a non-image area in a reproduced image.

Specifically, the resin grains of the present invention have a maximum grain diameter of at most 10 μm, preferably at most 5 μm and an average grain diameter of at most 1.0 μm, preferably at most 0.5 μm. The specific surface areas of the hydrophilic resin grains are increased with the decrease of the grain diameter, resulting in good electrophotographic properties, and the grain size of colloidal grains, i.e., about 0.01 μm or smaller is sufficient. However, very small grains cause the similar troubles to those in the case of molecular dispersion and accordingly a grain size of 0.001 μm or larger is preferable. On the other hand, zinc oxide has generally a grain diameter of 0.05 to 10 μm, preferably 0.1 to 5 μm.

In the present invention, the hydrophilic resin grains having a high order network structure do not meet with dissolving-out with damping water during printing so that good printing properties can be maintained even after a number of prints are obtained.

In the present invention, the hydrophilic resin grains having no such a high order network structure (which will hereinafter be referred to as simply "hydrophilic resin grains") or the hydrophilic resin grains having a high order network structure (which will hereinafter be referred to as simply "network hydrophilic resin grains") are preferably used in a proportion of 0.1 to 20% by weight to 100 parts by weight of photoconductive zinc oxide, since if the hydrophilic resin grains or network hydrophilic resin grains are less than 0.1% by weight, the hydrophilic property of a non-image area does not become sufficient, while if more than 20% by weight, the hydrophilic property of a non-image area is further improved, but electrophotographic properties and reproduced images are deteriorated.

As the hydrophilic resin of the present invention, optionally having a higher order network structure, there can favorably be used any of synthetic and natural hydrophilic resins, for example, described in P. Molyneax "Water-Soluble Synthetic Polymers: Properties and Behavior" Vol. I and Vol. II, CRC Press Inc. (1982); C. A. Finch "Chemistry and Technology of Water-Soluble Polymers" Plenam Press (1983); Matao Nakamura "Water-Soluble Polymers (Suiyosei Kobunshi)" Kagaku Kogyo-sha (1973); Kaimen Kagaku Kenkyukai "New Processing and Modifying Technique and Development of Uses of Water-Soluble Polymers Aqueous Dispersion Type Resins" Keiei Kaihatsu Center Shuppan-bu (1981) and Davidson "Water-Soluble Resin" Reinhold (1968).

The synthetic hydrophilic resins include those containing, in the molecular structures, at least one hydrophilic group selected from the group consisting of ether group, ethylene oxide group, —OH, —SH, —COOH, $—SO_2H$, $—SO_3H$, $—PO_3H_2$, —CN, $—CONH_2$, —CHO, $—SO_2R_8$,

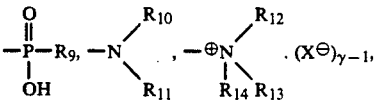

4- to 6-membered heterocyclic ring optionally containing at least one nitrogen atom and organosilane group.

In the above described hydrophilic groups, $R_8$ is a hydrocarbon group containing 1 to 6 carbon atoms, preferably 1 to 4 carbon atoms, which can be substituted, for example, methyl, ethyl, propyl, butyl, 2-chloroethyl, 2-bromoethyl, 2-fluoroethyl, 3-chloropropyl, 3-methoxypropyl, 2-methoxybutyl, benzyl, phenyl, propenyl, methoxymethyl, ethoxymethyl and 2-methoxyethyl groups.

$R_9$ is an aliphatic group containing 1 to 6 carbon atoms, preferably 1 to 4 carbon atoms, which can be substituted, i.e., the similar group to $R_8$ or $—OR_9'$ wherein $R_9'$ has the same meaning as $R_8$.

$R_{10}$ and $R_{11}$ being same or different represent hydrogen atoms or hydrocarbon groups containing 1 to 6 carbon atoms, preferably 1 to 4 carbon atoms, which can be substituted, i.e., have the same meaning as $R_8$. The sum of carbon atoms in $R_{10}$ and $R_{11}$ are at most 8, preferably at most 6.

$R_{12}$, $R_{13}$ and $R_{14}$ have the same meanings as $R_{10}$ and $R_{11}$, which can be same or different.

$X^{\ominus}$ is an anion, for example, halide ion such as chloride ion, bromide ion or iodide ion, perchlorate ion, tetrafluoroborate ion, hydroxide ion, carboxylate ion such as acetonate ion or propionate ion, sulfonate ion such as methanesulfonate ion, benzenesulfonate ion or p-toluenesulfonate ion, or the like.

$\gamma$ is 1 or 2 and when $\gamma=1$, $R_{12}$ to $R_{14}$ contain at least one acidic group such as $—SO_3H$, $—PO_3H_2$ or —COOH as a substituent. A typical example is

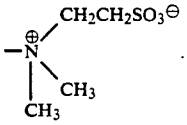

Each of the above described groups, —COOH, $—SO_2H$, $—SO_3H$, $—PO_3H_2$, and

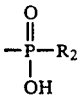

can form a salt with an alkali metal such as lithium, sodium or potassium, alkaline earth metal such as calcium or magnesium, or other metals such as zinc and aluminum, or an organic base such as triethylamine, pyridine, morpholine or piperazine.

Examples of the 4- to 6-membered heterocyclic ring optionally containing at least one nitrogen atom, as described above, are pyridine ring, piperidine ring, pyrrole ring, imidazole ring, pyrazine ring, pyrrolidine ring, pyrroline ring, imidazoline ring, pyrazolidine ring, piperazine ring, morpholine ring, pyrrolidone ring and the like. These heterocyclic rings can be substituted by substituents, illustrative of which are halogen atoms such as fluorine, chlorine and bromine atoms; optionally substituted hydrocarbon groups containing 1 to 8 carbon atoms, which can be substituted, such as methyl, ethyl, propyl, butyl, 2-chloroethyl, 2-bromoethyl, 2-hydroxyethyl, 2-cyanoethyl, 2-methoxyethyl, 2-ethoxyethyl, 2-butoxyethyl, 2-carboxyethyl, carboxymethyl, 3-sulfopropyl, 4-sulfobutyl, 2-methoxycarbonylethyl, 2-ethoxycarbonylethyl, 2-methanesulfonylethyl, benzyl, carboxybenzyl, carboxymethylbenzyl, phenyl, carboxyphenyl, sulfophenyl, methanesulfonylphenyl, ethanesulfonylphenyl, carboxymethylphenyl, methoxyphenyl, chlorophenyl groups and the like; $—OR_{15}$ groups wherein $R_{15}$ represents the above described hydrocarbon groups containing 1 to 8 carbon atoms, which can be substituted and $—COOR_{16}$ groups wherein $R_{16}$ has the same meaning as $R_{15}$.

The organosilane group includes, for example, a recurring unit represented by the following general formula (IV):

(IV)

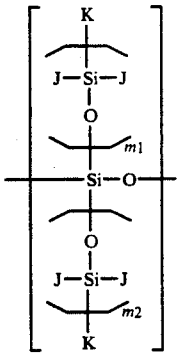

wherein J is an alkyl group containing 1 to 4 carbon atoms, which can be substituted, such as methyl, ethyl, propyl, butyl, 2-chloroethyl, 2-methoxyethyl, 2-cyanoethyl groups and the like; $—OR_{17}$ group wherein $R_{17}$ has the same meaning as J or —"$Z_1$" group wherein $Z_1$ is trimethylsiloxy, pentamethyldisiloxanyl, heptamethyltrisiloxanyl, nonamethyltetrasiloxanyl, bis(trimethylsiloxy)methylsiloxanyl, tris(trimethylsiloxy) siloxanyl group or the like, and K is an alkyl group containing 1 to 6 carbon atoms, which can be substituted, such as methyl, ethyl, propyl, butyl, hexyl, 2-methoxyethyl, 2-ethoxypropyl, 2-cyanoethyl, 2-hydroxyethyl, 2-hydroxy-3-chloropropyl or 2-chloroethyl group, $—OR_{18}$ group wherein $R_{18}$ has the same meaning as $R_{17}$ or a group such that an unsaturated bond selected from the group consisting of vinyl, methacryloxy, acryloxy, methacrylamide, acrylamide, styryl and allyl groups is polymerized and combined with another recurring unit through a divalent hydrocarbon group containing 1 to 6 carbon atoms, and $m_1$ and $m_2$ each is 0 or an integer of 1 to 10, the sum of $m_1+m_2$ being at least 2.

The hydrophilic resin of the present invention is a homopolymer or copolymer comprising a polymeric component having at least one of the hydrophilic groups in the polymer side chain, the polymeric component being in a proportion of 20 to 100% by weight, preferably 30 to 100% by weight to the resin.

More specifically, this hydrophilic group-containing polymeric component is represented, for example, by the following general formula (V):

(V)

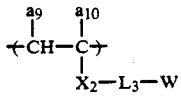

In the general formula (V), $X_2$ is a direct bond or —COO—, —OCO—, —O—, $—SO_2—$,

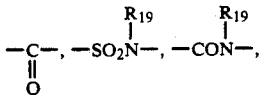

—CONHCOO—, —CONHCONH—,

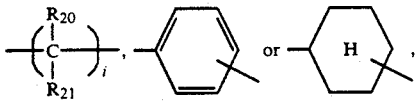

wherein $R_{19}$ represents hydrogen atom or optionally substituted hydrocarbon groups containing 1 to 7 carbon atoms such as methyl, ethyl, propyl, butyl, 2-chloroethyl, 2-hydroxyethyl, 3-bromo-2-hydroxypropyl, 2-carboxyethyl, 3-carboxypropyl, 4-carboxybutyl, 3-sulfopropyl, benzyl, sulfobenzyl, methoxybenzyl, carboxybenzyl, phenyl, sulfophenyl, carboxyphenyl, hydroxyphenyl, 2-methoxyethyl, 3-methoxypropyl, 2-methanesulfonylethyl, 2-cyanoethyl, N,N-(dichloroethyl)aminobenzyl, N,N-(dihydroxyethyl)aminobenzyl, chlorobenzyl, methylbenzyl, N,N-(dihydroxyethyl) aminophenyl, methanesulfonylphenyl, cyanophenyl, dicyanophenyl, acetylphenyl groups and the like, $R_{20}$ and $R_{21}$ each represent, same or different, hydrogen atom, halogen atoms such as fluorine, chlorine, and bromine atoms and aliphatic groups containing 1 to 4 carbon atoms, in particular, alkyl groups such as methyl, ethyl, propyl and butyl groups, and i represents an integer of 1 to 6.

W is the foregoing hydrophilic group, i.e., ether group, ethylene oxide group, —OH, —SH, —CHO, —CN, —COOH, $—SO_2H$, $—SO_3H$, $—PO_3H_2$, $—CONH_2$, $—SO_2R_8$,

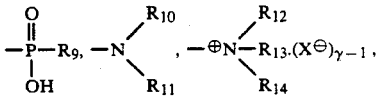

4- to 6-membered heterocyclic rings optionally containing at least one nitrogen atom or organosilane group, wherein $R_8$ to $R_{14}$ have the same meaning as the foregoing $R_8$ to $R_{14}$.

$L_3$ is a linking group selected from the group consisting of

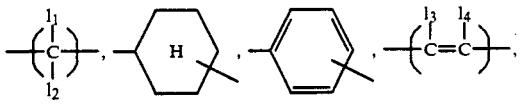

—COO—, —OCO—, —O—, —S—, $—SO_2—$,

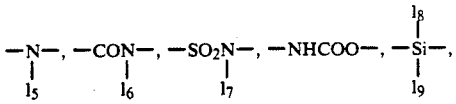

—NHCONH— and —C—, or a bonding group formed by combination of these linking groups, wherein $l_1$ to $l_4$ represent, same or different, hydrogen atom, halogen atoms such as fluorine, chlorine and bromine atoms, hydrocarbon groups containing 1 to 7 carbon atoms which can be substituted, such as methyl, ethyl, propyl, butyl, 2-chloroethyl, 2-methoxyethyl, 2-methoxycarbonylethyl, benzyl, methoxybenzyl, phenyl, methoxyphenyl, methoxycarbonylphenyl groups and the like and —($L_3$—W) groups in the general formula (V), and $l_5$ to $l_9$ have the same meaning as $R_{19}$.

In the general formula (V), $a_9$ and $a_{10}$ represent, same or different, hydrogen atom, halogen atoms such as fluorine, chlorine and bromine atoms, —COOH, $—COOR_{22}$ and $—CH_2COOR_{22}$ wherein $R_{22}$ represents a hydrocarbon group containing 1 to 7 carbon atoms, in particular, the same hydrocarbon groups as in $R_{19}$, and alkyl groups containing 1 to 4 carbon atoms, such as methyl, ethyl, propyl and butyl groups.

Examples of the above described hydrophilic group-containing polymeric component are given below without limiting the scope of the present invention:

(a-1)

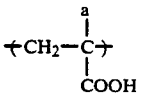

a: —H, —$CH_3$, —Cl, —$CH_2COOH$, —$CH_2COOCH_3$ (a-2)

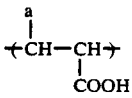

a: —$CH_3$, —COOH, —$CONH_2$, —$CONHC_2H_5$, —$COOCH_3$ (a-3)

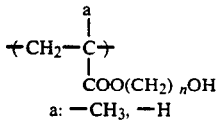

a: —$CH_3$, —H
n: integer of 1~12

(a-4)

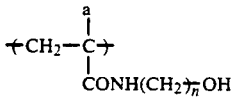

a: —H, —$CH_3$, —Cl
n: integer of 1~12

(a-5)

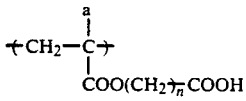

a: —H, —$CH_3$, —$CH_2COOH$, —$CH_2COOCH_3$
n: integer of 1~12

(a-6)

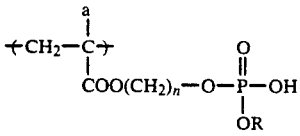

a: —H, $CH_3$
n: integer of 1~12
R: —H, —$CH_3$, —$C_2H_5$ (a-7)

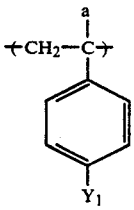

a: —H, —$CH_3$ $Y_1$: —$SO_3H$, —COOH, —$CH_2OH$, —O—P(=O)(OH)—OH, —$SO_2H$, —$CONH_2$, —$SO_2NH_2$ (a-8)

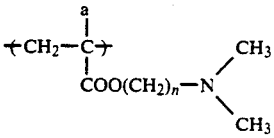

a: —H, —$CH_3$
n: integer of 1~4

-continued (a-9)

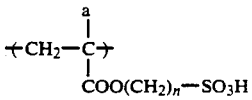

a: —H, —$CH_3$
n: integer of 2~12

(a-10)

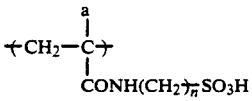

a: —H, —$CH_3$
n: integer of 2~12

(a-11)

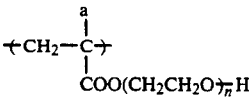

a: —H, —$CH_3$
n: integer of 1~4

(a-12)

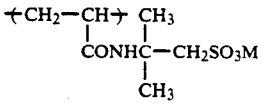

M: Li, Na, K, $HN(C_2H_5)_3$, H—N 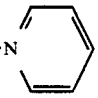

(a-13)

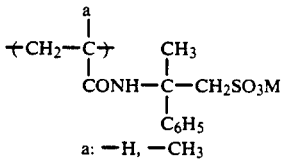

a: —H, —$CH_3$

M: Li, Na, K, $HN(C_2H_5)_3$, H—N 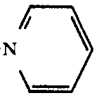

(a-14)

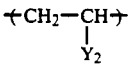

$Y_2$: —OH, —$NH_2$ (a-15)

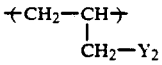

$Y_2$: —OH, —$NH_2$ (a-16)

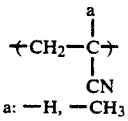

a: —H, —$CH_3$ (a-17)

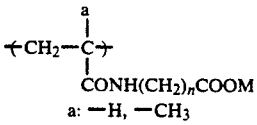

a: —H, —$CH_3$
n: integer of 1~11
M: Li, Na, K, H—$N(C_2H_5)_3$ (a-18)

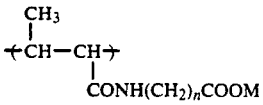

n: integer of 1~11
M: Li, Na, K, H—$N(C_2H_5)_3$

-continued
(a-19)
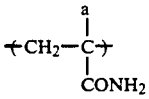
a: —H, —$CH_3$
(a-20)
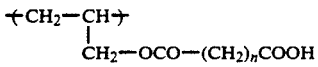
n: integer of 1~4
(a-21)
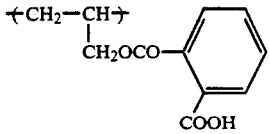
(a-22)
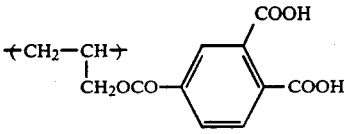
(a-23)
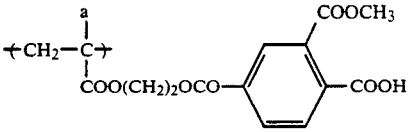
a: —H, —$CH_3$
(a-24)
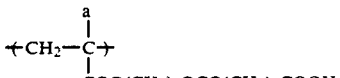
a: —H, —$CH_3$
n: integer of 1~10
(a-25)
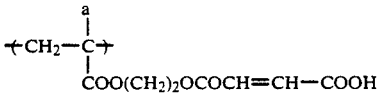
a: —H, —$CH_3$, —$CH_2COOCH_3$
(a-26)
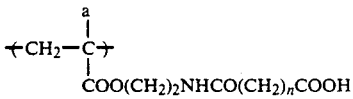
a: —H, —$CH_3$
n: integer of 1~10
(a-27)
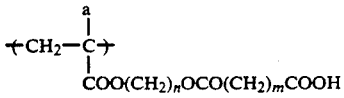
a: —H, —$CH_3$, —$CH_2COOCH_3$
n: integer of 2~10
m: integer of 1~10 [(n + m) = 10 or less]
(a-28)
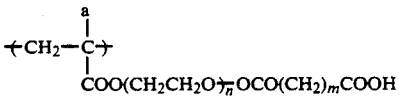
a: —H, —$CH_3$, —Cl
n: integer of 1~4
m: integer of 1~4
(a-29)
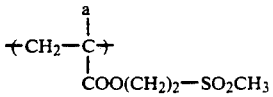
a: —$CH_3$, —H
-continued
(a-30)
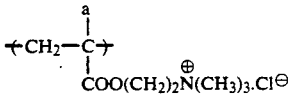
a: —H, —$CH_2$
(a-31)
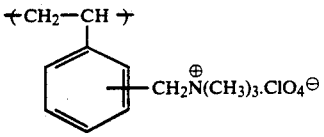
(a-32)
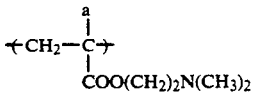
a: —H, —$CH_3$
(a-33)
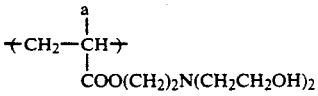
a: —H, —$CH_3$
(a-34)
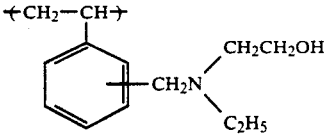
(a-35)
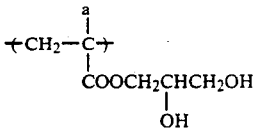
a: —H, —$CH_3$
(a-36)
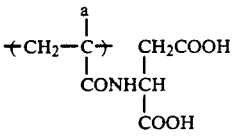
a: —H, —$CH_3$
(a-37)
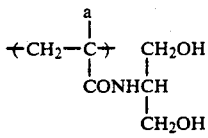
a: —H, —$CH_3$
(a-38)
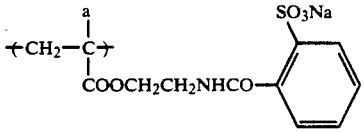
a: —H, —$CH_3$
(a-39)
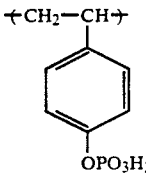

-continued (a-40)

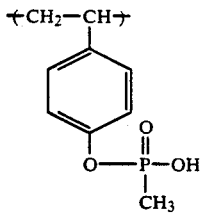

(a-41)

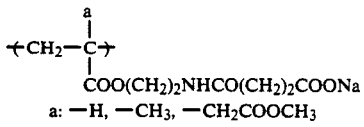

a: —H, —$CH_3$, —$CH_2COOCH_3$ (a-42)

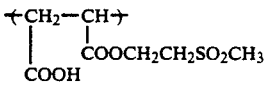

(a-43)

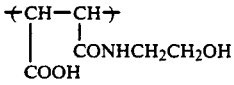

(a-44)

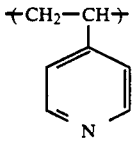

(a-45)

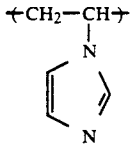

(a-46)

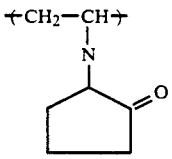

(a-47)

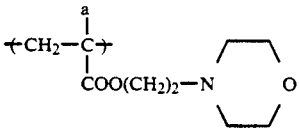

a: —H, —$CH_3$ (a-48)

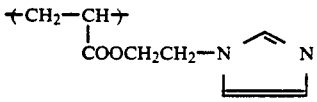

(a-49)

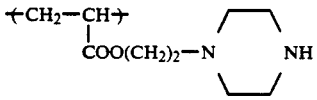

(a-50)

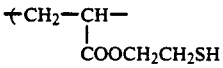

(a-51)

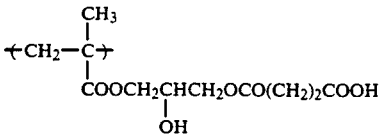

-continued (a-52)

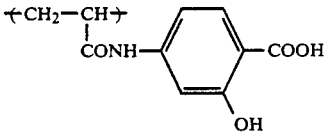

(a-53)

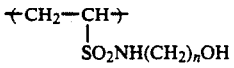

n: integer of 1~4

(a-54)

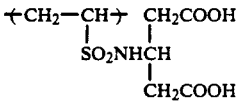

(a-55)

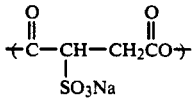

(a-56)

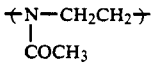

(a-57)

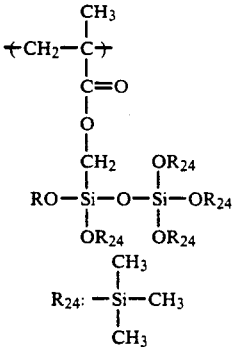

As other polymeric components which can be copolymerized with the above described hydrophilic group-containing polymeric components, for example, there can be used those represented by the following general formula (Ia) and/or (Ib).

Natural hydrophilic resins are described in detail in the foregoing comprehensive technical materials of water-soluble high molecular water dispersion type resins (Keiei Kaihatsu Center Shuppan-bu), for example, lignin, glucose starch, pullulan, cellulose, alginic acid, dextran, dextrin, gum guar, gum arabic, glycogen, lamiran, lichenin, nigeran and derivatives thereof. As these derivatives, there can be used preferably sulfonated, carboxylated, phosphated, sulfoalkylated, carboxyalkylated, alkylphosphated ones and salts thereof. Two or more natural hydrophilic resins can be used.

Among the natural hydrophilic resins, glucose polymers and derivatives are preferable and above all, starch, glycogen, cellulose, lichenin, dextran and nigeran are more preferable. In particular, dextran and derivatives thereof are most preferable.

Production of fine grains or particles of the above described synthetic or natural hydrophilic resin having a specified grain diameter can be carried out by employing a dry or wet method well known in the art, for example, (a) a method comprising directly pulverizing the hydrophilic resin powder by a pulverizing mill of the prior art, such as ball mill, paint shaker, jet mill, hammer mill, etc. and thus obtaining fine grains and (b) a method of obtaining high molecular latex grains. The latter method of obtaining high molecular latex grains can be carried out according to the prior art method for producing latex grains of paints or liquid developers for electrophotography. That is, this method comprises dispersing the hydrophilic resin by the joint use of a dispersing polymer, more specifically previously mixing the hydrophilic resin and dispersion aid polymer or coating polymer, followed by pulverizing, and then dispersing the pulverized mixture in the presence of the dispersing polymer.

For example, these methods are described in "Flowing and Pigment Dispersion of Paints" translated by Kenji Ueki and published by Kyoritsu Shuppan (1971), Solomon "Chemistry of Paints", "Paint and Surface Coating Theory and Practice", Yuji Harasaki "Coating Engineering (Coating Kogaku)" published by Asakura Shoten (1971), Yuji Harasaki "Fundamental Science of Coating (Kiso Kagaku of Coating)" by Maki Shoten (1977) and Japanese Patent Laid-Open Publication Nos. 96954/1987, 115171/1987 and 75651/1987.

Furthermore, the prior art method of obtaining readily latex grains or particles by suspension polymerization or dispersion polymerization can also be used in the present invention, for example, as described in Soichi Muroi "Chemistry of High Molecular Latex (Kobunshi Latex no Kagaku)" published by Kobunshi Kankokai (1970), Taira Okuda and Hiroshi Inagaki "Synthetic Resin Emulsions (Gosei Jushi Emulsion)" published by Kobunshi Kankokai (1978), Soichi Muroi "Introduction to High Molecular Latexes (Kobunshi Latex Nyumon)" published by Kobunsha (1983).

In the present invention, it is preferable to use a method of obtaining high molecular latex grains, whereby resin grains with an average grain diameter of at most 1.0 μm can readily be obtained.

In the electrophotographic lithographic printing plate precursor of the present invention, formation of a photoconductive layer can be carried out by any of methods of dispersing photoconductive zinc oxide in an aqueous system, for example, described in Japanese Patent Publication Nos. 450/1976, 18599/1972 and 41350/1971 and methods of dispersing in a non-aqueous solvent system, for example, described in Japanese Patent Publication No. 31011/1975 and Japanese Patent Laid-Open Publication Nos. 54027/1978, 20735/1979, 202544/1982 and 68046/1983. If water remains in the photoconductive layer, however, the electrophotographic property is deteriorated, and accordingly, the latter methods using a non-aqueous solvent system is preferable. Therefore, in order to adequately disperse the hydrophilic resin latex grains of the present invention in the photoconductive layer dispersed in a non-aqueous system, the latex grains are preferably non-aqueous system latex grains.

As the non-aqueous solvent for the non-aqueous system latex, there can be used any of organic solvents having a boiling point of at most 200° C., individually or in combination. Useful examples of the organic solvent are alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing 6 to 14 carbon atoms such as hexane, octane, decane, dodecane, tridecane, cyclohexane and cyclooctane, aromatic hydrocarbons such as benzene, toluene, xylene and chlorobenzene and halogenated hydrocarbons such as methylene chloride, dichloroethane, tetrachloroethane, chloroform, methylchloroform, dichloropropane and trichloroethane.

When a high molecular latex is synthesized by the dispersion polymerization method in a non-aqueous solvent system, the average grain diameter of the latex grains can readily be adjusted to at most 1 μm while simultaneously obtaining grains of monodisperse system with a very narrow distribution of grain diameters. Such a method is described in, for example, K. E. J. Barrett "Dispersion Polymerization in Organic Media" John Wiley & Sons (1975), Koichiro Murata "Polymer Processings (Kobunshi Kako)" 23, 20 (1974), Tsunetaka Matsumoto and Toyokichi Tange "Journal of Japan Adhesive Association (Nippon Setchaku Kyokaishi)" 9, 183 (1973), Toyokichi Tange "Journal of Japan Adhesive Association" 23, 26 (1987), D. J. Walbridge "NATO. Adv. Study Inst. Ser. E." No. 67, 40 (1983), British Patent No.s 893,429 and 934,038 and U.S. Pat. Nos. 1,122,397, 3,900,412 and 4,606,989, and Japanese Patent Laid-Open Publication Nos. 179751/1985 and 185963/1985.

Specifically, the network hydrophilic resin grains consist of a homopolymer or copolymer containing polymeric components containing in the polymer side chain at least one of the specific hydrophilic group-containing components, specifically described above, in at least one structure of the recurring units of the polymer and as in the case of the foregoing hydrophilic resins, the said polymeric components are contained as the polymeric components of the resin in a proportion of 20 to 100% by weight, preferably 30 to 100% by weight.

The specific general formulae and component examples of this network hydrophilic resin are substantially the same as the general formulae (IV) and (V) and component examples (a-1) to (a-57) of the foregoing hydrophilic resins.

Examples of the network natural hydrophilic resin are described in detail in Kaimen Kagaku Kenkyukai "New Processing and Modifying Technique and Development of Uses of Water-Soluble Polymers and Aqueous Dispersion Type Resins", Keiei Kaihatsu Center Shuppan-bu (1981); Matao Nakamura "Water-Soluble Polymers (Suiyosei Kobunshi)" Kagaku Kogyo-sha (1973); R. L. Davidson "Handbook of Water-Soluble Gums and Resins" McGraw-Hill Book Company (1980); and "Encyclopedia of Polymer Science and Engineering" Vol. 3, pp. 69–270, John Wiley and Sons (1985).

Examples of the network hydrophilic resin include the foregoing natural hydrophilic resins and derivatives thereof.

The network hydrophilic resin grains of the present invention consist of the hydrophilic polymeric components as described above, in which polymer molecule chains are crosslinked to form higher order network structures. Thus, the hydrophilic resin grains are made hardly soluble or insoluble in water, so that the solubility of the resin in water is at most 80% by weight, preferably 50% by weight.

The crosslinking according to the present invention can be carried out by known methods, that is, (1) method comprising crosslinking a polymer containing the hydrophilic component with various crosslinking agents or hardening agents, (2) method comprising polymerizing a monomer corresponding to the hydrophilic polymeric component in the presence of a multifunctional monomer or multifunctional oligomer containing two or more polymerizable functional groups to form a network structure among the molecules and (3) method comprising subjecting polymers containing the hydrophilic polymeric components and reactive groups to polymerization reaction or polymer reaction and thereby effecting crosslinking.

As the crosslinking agent in the above described method (1), there can be used compounds commonly used as crosslinking agents, for example, described in Shinzo Yamashita and Tosuke Kaneko "Handbook of Crosslinking Agents (Kakyozai Handbook)" published by Taiseisha (1981) and Kobunshi Gakkai Edition "High Molecular Data Handbook -Basis- (Kobunshi Data Handbook -Kisohen-)" published by Baihunkan (1986).

Examples of the crosslinking agent are organosilane compounds such as vinyltrimethoxysilane, vinyltributoxysilane, γ-glycidoxypropyltrimethoxysilane, γ-mercaptopropyltriethoxysilane, γ-aminopropyltriethoxysilane and other silane coupling agents; polyisocyanate compounds such as tolylene diisocyanate, o-tolylene diisocyanate, diphenylmethane diisocyanate, triphenylmethane diisocyanate, polymethylenepolyphenyl isocyanate, hexamethylene diisocyanate, isophorone diisocyanate, high molecular polyisocyanates; polyol compounds such as 1,4-butanediol, polyoxypropylene glycol, polyoxyalkylene glycol, 1,1,1-trimethylolpropane and the like; polyamine compounds such as ethylenediamine, γ-hydroxypropylated ethylenediamine, phenylenediamine, hexamethylenediamine, N-aminoethylpiperazine, modified aliphatic polyamines and the like; polyepoxy group-containing compounds and epoxy resins, for example, as described in Kakiuchi Hiroshi "New Epoxy Resins (Shin Epoxy Jushi)" published by Shokodo (1985), and Kuniyuki Hashimoto "Epoxy Resins (Epoxy Jushi)" published by Nikkan Kogyo Shinbunsha (1969); melamine resins such as described in Ichiro Miwa and Hideo Matsunaga "Urea and Melamine Resins (Urea-Melamine Jushi)" published by Nikkan Kogyo Shinbunsha (1969); and poly(-meth)acrylate compounds as described in Shin Ogawara, Takeo Saegusa and Toshinobu Higashimura "Oligomers" published by Kodansha (1976) and Eizo Omori "Functional Acrylic Resins" published by Technosystem (1985), for example, polyethylene glycol diacrylate, neopentyl glycol diacrylate, 1,6-hexanediol diacrylate, trimethylolpropane triacrylate, pentaerythritol polyacrylate, bisphenol A-diglycidyl ether diacrylate, oligoester acrylate and methacrylates thereof and the like.

Of the hardening agents used in the above described method (1), natural hydrophilic resins such as gelatin, as the hardening agent, include those described in U.S. Pat. Nos. 3,057,723; 3,671,256; 3,396,029; 4,161,407 and 4,207,109; British Patent No. 1,322,971; Japanese Patent Publication No. 17112/1967; Japanese Patent Laid-Open Publication Nos. 94817/1976, 66841/1981, 207243/1982 and 12132/1984; "The Theory of the Photographic Process" 4th Edition (T. H. James et al.) page 94 and "Polymeric Amines and Ammonium Salts" (E. J. Gehtals et al.) page 21.

Examples of the polymerizable function group of the multifunctional monomer or multifunctional oligomer containing at least two polymerizable functional groups, used in the above described method (2), are:

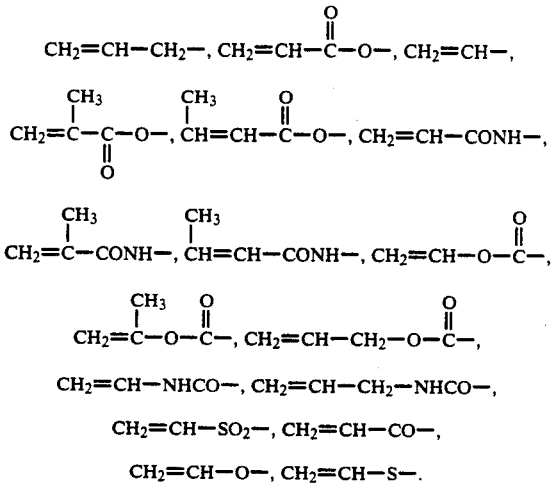

Any of monomers or oligomers containing two or more same or different ones of these polymerizable functional groups can be used in the present invention.

Of these monomers or oligomers, as the monomer or oligomer having two or more same polymerizable functional groups, there can be used styrene derivatives such as divinyl benzene and trivinyl benzene; esters of polyhydric alcohols such as ethylene glycol, diethylene glycol, triethylene glycol, polyethylene glycols Nos. 200, 400 and 600, 1,3-butylene glycol, neopentyl glycol, dipropylene glyclol, polypropylene glycol, trimethylolpropane, trimethylolethane, pentaerythritol and the like or polyhydroxyphenols such as hydroquinone, resorcinol, catechol and derivatives thereof with methacrylic acid, acrylic acid or crotonic acid, vinyl ethers and allyl ethers; vinyl esters of dibasic acids such as malonic acid, succinic acid, glutaric acid, adipic acid, pimelic acid, maleic acid, phthalic acid, itaconic acid and the like, allyl esters, vinylamides and allylamides; and condensates of polyamines such as ethylenediamine, 1,3-propylenediamine, 1,4-butylenediamine and the like with carboxylic acids containing vinyl groups such as methacrylic acid, acrylic acid, crotonic acid, allylacetic acid and the like.

As the monomer or oligomer having two or more different polymerizable functional groups, there can be used, for example, ester derivatives or amide derivatives containing vinyl groups of carboxylic acids containing vinyl group, such as methacrylic acid, acrylic acid, methacryloylacetic acid, acryloylacetic acid, methacryloylpropionic acid, acryloylpropionic acid, itaconyloylacetic acid and itaconyloylpropionic acid, reaction products of carboxylic anhydrides with alcohols or amines such as allyloxycarbonylpropionic acid, allyloxycarbonylacetic acid, 2-allyloxycarbonylbenzoic acid, allylaminocarbonylpropionic acid and the like, for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, 2-(vinyloxycarbonyl)ethyl ester of acrylic acid, N-allylacrylamide, N-allylmethacrylamide, N-allylitaconamide, methcaryloylpropionic acid allylamide and the like; and condensates of amino alcohols such as aminoethanol, 1-aminopropanol, 1-aminobutanol, 1-aminohexanol, 2-aminobutanol and the like with carboxylic acids containing vinyl groups.

The monomer or oligomer containing two or more polymerizable functional groups of the present invention is generally used in a proportion of at most 10 mole %, preferably at most 5 mole % to all monomers, which is polymerized to form a resin.

In the present invention, there can be used a polymer containing polymerizable double bond groups illustrative of which are the above described similar groups. The polymerization reaction among the polymers can be carried out jointly using the above described polymerizable multifunctional monomer, as well known in the art.

The crosslinking of polymers by reacting reactive groups among the polymers and forming chemical bonds according to the foregoing method (3) can be carried out in the similar manner to the ordinary reactions of organic low molecular compounds, for example, as disclosed in Yoshio Iwakura and Keisuke Kurita "Reactive Polymers (Hannosei Kobunshi)" published by Kohdansha (1977) and Ryohei Oda "High Molecular Fine Chemical (Kobunshi Fine Chemical)" published by Kohdansha (1976). Combination of functional groups classified as Group A (hydrophilic polymeric component) and functional groups classified as Group B (polymers comprising components containing reactive groups) in the following Table 1 has well been known for effectively accomplishing the polymer reactions. In Table 1, $R_{25}$ and $R_{26}$ are hydrocarbon groups having the same meanings as $l_8$ and $l_9$ in $L_3$ of the foregoing General Formula (V).

TABLE 1

| Group A | Group B |
|---|---|
| $-COOH$, $-PO_3H_2$ | 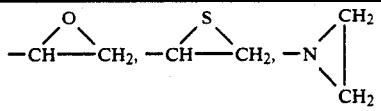 |
| $-OH$, $-SH$ | |
| $-NH_2$ | $-COCl$, $-SO_2Cl$, cyclic acid anhydride |
| $-SO_2H$ | $-N=C=O$, $-N=C=S$, |
| | 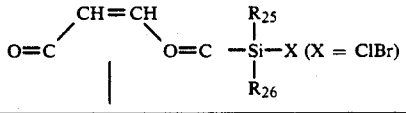 |

As illustrated above, the network hydrophilic resin grains of the present invention are polymer grains comprising hydrophilic group-containing polymeric components and having high order crosslinking structures among molecular chains, and for example, hydrogels or highly hydroscopic resins can be used therefor, as described in L. H. Sperling "Interpenetrating Polymer Networks and Related materials" Plenum Press (1981), "Encyclopedia of Polymer Science and Engineering" Vol. 8, pp. 279-340 (1985), J. D. Anclrade "Hydrogels for Medical and Related Application", ACS Symposium Series No. 31, American Chemical Society, Washington D.C. (1976), Eizo Omori "Development Tendency and Use Development of Highly Hygroscopic Resins (Kokyusuisei Jushi no Kaihatsu Doko to sono Yoto Tenkai)" Technoforum Shuppanbu KK (1987), Masahiro Irie "Production and Application of Functional High Molecular Gels (Kinosei Kobunshi Gel no Seizo to Oyo)" published by C.M.C KK (1987), Kenji Tanaka "Petrotech." 10, 25 (1987), "Nikkei New Materials" June 1, 1987, page 57, Jun Taguchi and Kunio Ishii "Science and Industry (Kagaku to Kogyo)" 59, 188 (1985), Fusayoshi Masuda "Functional Materials (Kino Zairyo)" No. 4, p. 36 (1982) and Yoshinori Monma "Chemical Industry (Kagaku Kogyo)" 38, 602 (1987).

Examples of commercially available highly hygroscopic resins are Arasoap (-commercial name-, made by Arakawa Kagaku Kogyo KK), Wondergel (-commercial name-, made by Kao KK), KI Gel (-commercial name-, made by Kurare Isoprene KK), Sanwet (-commercial name-, made by Sanyo Kasei Kogyo KK), Sumika Gel (-commercial name, Sumitomo Kagaku Kogyo KK), Aquakeep (-commercial name-, made by Seitetsu Kagaku Kogyo KK), Lanseal (-commercial name-, made by Nippon Exslan Kogyo KK), Lion Polymer (-commercial name-, made by Lion KK), GP (-commercial name, made by Nippon Gosei Kagaku Kogyo KK), Aqualic (-commercial name-, made by Nippon Shokubai Kagaku Kogyo KK), Aquaprene (-commercial name-, made by Meisei Kagaku Kogyo KK), CLD (-commercial name-, made by Buckeye Cellulose Co.), D. W. A. L. (-commercial name-, Dow Chemical Co.), G. P. C. (-commercial name-, made by Grain Processing Co.), Aqualon (-commercial name-, made by Hercules Co.), Magic Water Gel (-commercial name-, made by Super Adsorbent Co.), Cecagum (-commercial name-, made by CEC Co.), Spon Signus (-commercial name-, made by Kanegafuchi Gosei Kagaku KK), super Rub (-commercial name-, made by Asahi Kasei Kogyo KK), etc.

In the present invention, granulation of the network hydrophilic resin grains is carried out in the similar manner to that of the foregoing hydrophilic resin grains.

Binder resins to be jointly used with the above described hydrophilic resin grains or network hydrophilic resin grains will now be illustrated:

The binder resin used in the present invention is composed of at least one of the low molecular weight Resin A having a weight average molecular weight of $1\times10^3$ to $2\times10^4$, containing at least 30% by weight of the specified polymeric components of recurring units represented by the foregoing General Formulae (I), (Ia) and/or (Ib) and having at least one of polar groups and/or cyclic acid anhydrides (in this specification, "polar groups" means to include "cyclic acid anhydride" unless otherwise indicated) bonded to one end of the polymer main chain, and at least one of Resin B having a weight average molecular weight of at least $3\times10^4$ and consisting of a comb type copolymer containing at least one of monofunctional macromonomers each having a weight average molecular weight of at most $2\times10^4$, having at least one of the specified polymeric components of recurring units represented by the foregoing General Formulae (IIa) and (IIb) and having a double bond group bonded to only one end of the main chain, represented by the foregoing General Formula (IIc), and at least one of the monomers represented by the foregoing General Formula (III).

As the low molecular weight Resin A, there is preferably used a Resin A having the polar group bonded to the end and containing the methacrylate component having the specified substituent containing a benzene ring having the specified substituted on 2- and/or 6-position or non-substituted naphthalene ring, which low molecular weight polymer will hereinafter be referred to as Resin A'.

As the high molecular weight Resin B, there is preferably used a Resin B consisting of a comb type copolymer containing at least one of the monofunctional Macromonomer M and at least one of the monomers represented by General Formula (III) and having the foregoing polar group bonded to the end of the polymer main chain, which high molecular weight polymer will hereinafter be referred to as Resin B'.

The acid group-containing binder resin of the prior art, as described above, has mainly been used for the offset master and has such a large molecular weight, e.g. at least $5\times10^4$ as to improve the printing durability due to maintenance of the film strength, and these copolymers are random copolymers in which the acid group-containing copolymeric components are existing at random in the polymer main chain.

According to the present invention, on the other hand, it is found that since Resin A contains methacrylate copolymeric components each having the specified substituent and has the polar group bonded to the end of the main chain, the polar group adsorbs on the stoichiometric defects of photoconductive zinc oxide and the molecular weight thereof is relatively small, so that the covering property of the surface of photoconductive zinc oxide is improved to compensate the trap of photoconductive zinc oxide and to markedly improve the humidity property, while dispersion of photoconductive zinc oxide is sufficiently carried out to prevent aggregation thereof.

Furthermore, it is found that Resin B renders sufficient the mechanical strength of a photoconductive layer whose mechanical strength is insufficient by only Resin A without deteriorating the excellent electrophotographic properties by the use of Resin A. That is, in the case of using the binder resin of the present invention, interaction of the adsorption and coating by the inorganic photoconductive material and binder resin can suitably be effected and the film strength of the coated electroconductive layer can be maintained.

This is probably due to the action of the binder resin according to the present invention as described below: That is, the intensity of the interaction between the inorganic photoconductive material and resin can be varied by using Resin A and Resin B as the binder resin of the inorganic photoconductive material and specifying the weight average molecular weight of the each resin, the content and bonded position of the polar groups in the resin. Thus, Resin A having a stronger interaction can selectively and suitably be adsorbed on the inorganic photoconductive material, while Resin B having a weaker interaction than Resin A moderately interacts with the inorganic photoconductive material to such an extent that the polar group bonded to the specific position of the polymer main chain in the resin does not deteriorate the electrophotographic properties and Resin B having a long molecular chain length and grafted chain length causes interaction of these molecular chains with each other, whereby the electrophotographic properties and the mechanical strength of the film can markedly be improved.

When Resin A' is particularly used as Resin A, the static properties, in particular, D. R. and $E_{1/10}$ can further be improved without deteriorating the excellent properties obtained by the use of Resin A. These benefits are hardly fluctuated even if the ambient conditions are changed, for example, from high temperature and high humidity to low temperature and low humidity.

When Resin B' is particularly used as Resin B, the static properties, in particular, D.R. and $E_{1/10}$ can further be improved as in the above described Resin A' without deteriorating the excellent properties obtained by the use of Resin A. These effects are hardly fluctuated even if the ambient conditions are changed, for example, from high temperature and high humidity to low temperature and low humidity and moreover, the film strength as well as the printing durability can be improved.

In the present invention, the surface of the photoconductive layer is rendered smooth. When using a photoreceptor comprising a photoconductive layer with a low surface smoothness as an electrophotographic lithographic printing plate precursor, the dispersion state of the photoconductive material, i.e. inorganic grains and binder resin is not suitable and the photoconductive layer is formed under such a state that aggregation exists. Consequently, even if an oil-desensitizing treatment is carried out with an oil-desensitizing solution, rendering a non-image area hydrophilic is not uniform, nor sufficient and adhesion of a printing ink during printing takes place to result in background stains.

The binder resin of the present invention will now be illustrated in greater detail:

Resin A contains at least 30% by weight of the recurring units represented by General Formula (I) as polymeric components and the specified polar group bonded to one end of the polymer main chain, and has a weight average molecular weight of $1\times10^3$ to $2\times10^4$, preferably $3\times10^3$ to $1\times10^4$. In addition, Resin A has a glass transition point of preferably −20° C. to 110° C., more preferably −10° C. to 90° C.

If the molecular weight of Resin A is less than $10^3$, the film-forming property is too lowered to maintain a sufficient film strength, while if more than $2\times10^4$, in a photoreceptor using a near infrared to infrared spectral sensitizing dye, fluctuation of the dark decay retention ratio and photosensitivity under severe conditions such as high temperature and high humidity or low temperature and low humidity is somewhat increased and consequently, the benefit of the present invention cannot sufficiently be obtained that a stable reproduced image can be obtained.

In Resin A, the polymeric components corresponding to the recurring unit of General Formula (I) are generally in a proportion of at least 30% by weight, preferably 50 to 97% by weight and the copolymeric components containing the polar groups are generally in a proportion of 0.5 to 15% by weight, preferably 1 to 10% by weight.

In Resin A', the methacrylate components corresponding to the recurring units of General Formula (Ia) and/or (Ib) are generally in a proportion of at least 30% by weight, preferably 50 to 90% by weight and the polar groups contained at the end of the polymer main chain are generally in a proportion of 0.5 to 15% by weight, preferably 1 to 10% by weight based on 100% by weight of Resin A'.

If the polar group in Resin A or Resin A' is less than 0.5% by weight, the initial potential is too low to obtain a sufficient image density, while if more than 15% by weight, the dispersibility is lowered in spite of its lower molecular weight, the high humidity property as to the film smoothness and electrophotographic character is deteriorated and background staining is increased when used as an offset master.

The recurring unit represented by the following General Formula (I), contained in a proportion of at least 30% by weight in Resin A will now be illustrated:

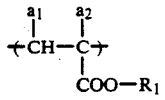

(I)

in which $a_1$ and $a_2$ each represent, same or different, hydrogen atom, halogen atoms such as chlorine, cyano group and hydrocarbon groups, e.g. alkyl groups containing 1 to 4 carbon atoms such as methyl, ethyl, propyl and butyl groups, and $R_1$ represents hydrocarbon groups, for example, optionally substituted alkyl groups containing 1 to 18 carbon atoms such as methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 3-hydroxypropyl groups, optionally substituted alkenyl groups containing 2 to 18 carbon atoms such as vinyl, allyl, isopropenyl, butenyl, hexenyl, heptenyl and octenyl groups, optionally substituted aralkyl groups containing 7 to 12 carbon atoms such as benzyl, phenethyl, naphthylmethyl, 2-naphthylethyl, methoxybenzyl, ethoxybenzyl and methylbenzyl groups, optionally substituted cycloalkyl groups containing 5 to 8 carbon atoms such as cyclopentyl, cyclohexyl and cycloheptyl groups and optionally substituted aryl groups such as phenyl, tolyl, xylyl, mesityl, naphthyl, methoxyphenyl, ethoxyphenyl, fluorophenyl, difluorophenyl, bromophenyl, chlorophenyl, dichlorophenyl, iodophenyl, methoxycarbonylphenyl, ethoxycarbonylphenyl, cyanophenyl and nitrophenyl groups.

More preferably, in General Formula (I), one of $a_1$ and $a_2$ is hydrogen atom and the other thereof is methyl group. More preferable examples of $R_1$ are alkyl groups containing 1 to 6 carbon atoms, aralkyl groups containing 1 to 6 carbon atoms and aryl groups which can be substituted.

Furthermore, preferable copolymeric components of Resin A are copolymeric components of methacrylates containing substituted benzene rings or naphthalene ring, represented by the following General Formula (Ia) and/or (Ib). Resin A' contains this copolymeric component and the copolymeric component containing the polar group.

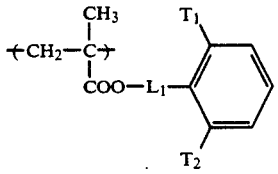

(Ia)

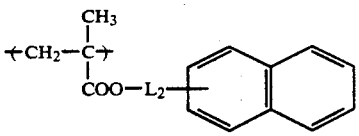

(Ib)

In Formula (Ia), preferably, $T_1$ and $T_2$ each represents, same or different, hydrogen atom, chlorine atom, bromine atom, hydrocarbon groups containing 1 to 10 carbon atoms, more preferably alkyl groups containing 1 to 4 carbon atoms such as methyl, ethyl, propyl and butyl groups, aralkyl groups containing 7 to 9 carbon atoms such as benzyl, phenethyl, 3-phenylpropyl, chlorobenzyl, dichlorobenzyl, bromobenzyl, methylbenzyl, methoxybenzyl and chloromethylbenzyl groups and aryl groups such as phenyl, tolyl, xylyl, bromophenyl, methoxyphenyl, chlorophenyl and dichlorophenyl groups, and $—COR_4$ and $—COOR_4$ wherein $R_4$ is preferably that described for the foregoing preferable hydrocarbon groups containing 1 to 10 carbon atoms. $T_1$ and $T_2$ are not simultaneously hydrogen atoms.

In General Formulae (Ia) and (Ib), $L_1$ and $L_2$ each represent a direct bond for bonding —COO— and benzene ring or bonding groups containing 1 to 4 bonding atoms such as $(CH_2—_n$ wherein n is an integer of 1 to 3, $—CH_2OCO—$, $—CH_2CH_2OCO—$, $(CH_2—_m$ wherein m is an integer of 1 or 2 and $—CH_2CH_2O—$, preferably a direct bond or bonding groups containing 1 or 2 bonding atoms.

Examples of the recurring unit represented by Formula (Ia) or (Ib), used in Resin A' of the present invention, will be given below without limiting the same. In the following (b-1) to (b-20), n is an integer of 1 to 4, m is 0 or an integer of 1 to 4, p is an integer of 1 to 3, $R_{27}$ to $R_{30}$ each represent $—C_nH_{2n+1}$ or $(CH_2—_mC_6H_5$ wherein n and m have the same meaning as described above, and X and X' each represent any of —Cl, —Br and —I.

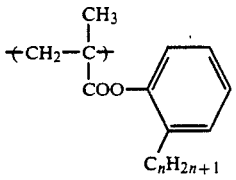

(b-1)

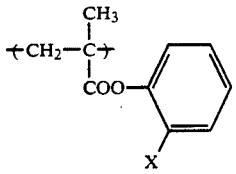

(b-2)

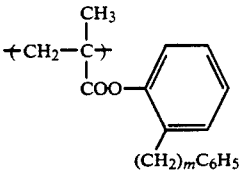

(b-3)

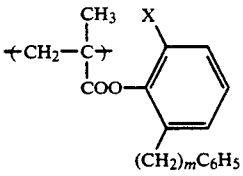

(b-4)

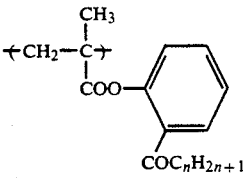

(b-5)

-continued (b-6)

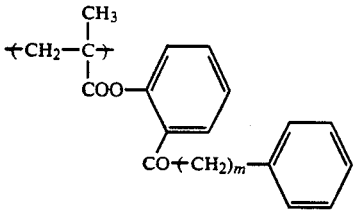

(b-7)

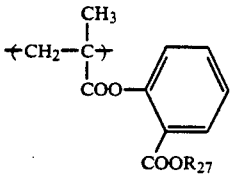

(b-8)

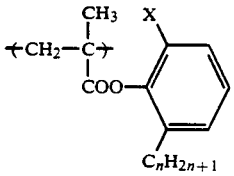

(b-9)

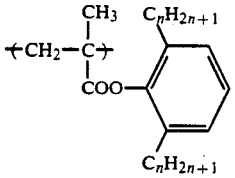

(b-10)

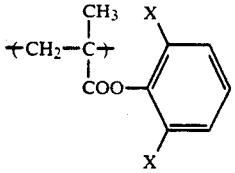

(b-11)

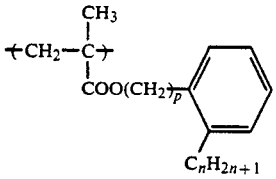

(b-12)

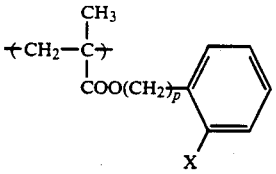

(b-13)

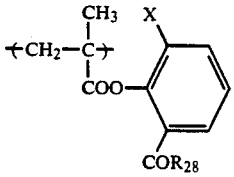

(b-14)

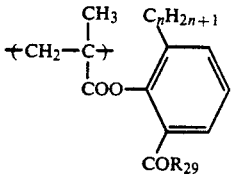

-continued (b-15)

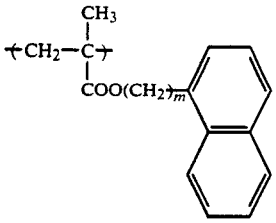

(b-16)

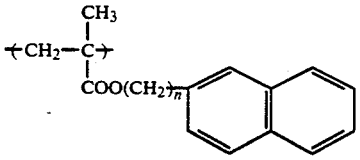

(b-17)

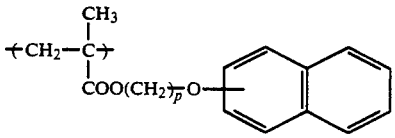

(b-18)

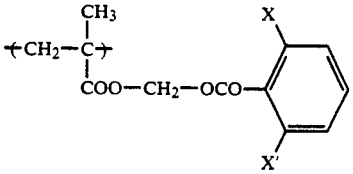

(b-19)

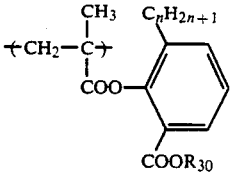

(b-20)

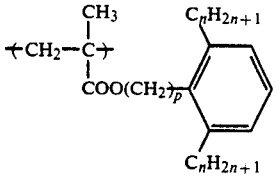

The polar group bonded to one end of the polymer main chain of Resin A will now be illustrated. The polar group is at least one member selected from the group consisting of $-PO_3H_2$, $-SO_3H$, $-COOH$, $-OH$,

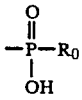

and cyclic acid anhydride-containing groups. Preferable groups are $-PO_3H_2$, $-SO_3H$, $-COOH$,

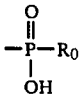

and cyclic acid anhydride-containing groups.

In

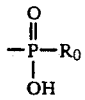

group, $R_0$ represents a hydrocarbon group or $—OR_0'$ wherein $R_0'$ represent a hydrocarbon group. Specifically, $R_0$ represents optionally substituted hydrocarbon groups containing 1 to 6 carbon atoms such as methyl, ethyl, propyl, butyl, 2-chloroethyl, 2-bromoethyl, 2-fluoroethyl, 3-chloropropyl, 3-methoxypropyl, 2-methoxybutyl, benzyl, phenyl, propenyl, methoxymethyl, ethoxymethyl and 2-methoxyethyl groups and $R_0'$ has the same meaning as $R_0$. $R_0$ and $R_0'$ have the same meaning as $R_9$ in

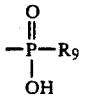

that the foregoing hydrophilic resin grains have.

The cyclic acid anhydride-containing group means a group containing at least one cyclic acid anhydride, illustrative of which are aliphatic dicarboxylic acid anhydrides and aromatic dicarboxylic acid anhydrides.

Examples of the aliphatic dicarboxylic acid anhydride include rings of succinic anhydride, glutaconic anhydride, maleic anhydride, cyclopentane-1,2-dicarboxylic anhydride, cyclohexane-1,2-dicarboxylic anhydride, cyclohexene-1,2-dicarboxylic anhydride and 2,3-bicyclo[2,2,2]octadicarboxylic anhydride. These rings can be substituted, for example, by halogen atoms such as chlorine and bromine atoms and/or alkyl groups such as methyl, ethyl, butyl and hexyl groups.

Examples of the aromatic dicarboxylic acid anhydride include rings of phthalic anhydride, naphthalene dicarboxylic anhydride, pyridine dicarboxylic anhydride and thiophene dicarboxylic anhydride. These rings can be substituted by, for example, halogen atoms such as chlorine and bromine atoms, alkyl groups such as methyl, ethyl, propyl and butyl groups, hydroxyl group, cyano group, nitro group, alkoxycarbonyl groups wherein alkoxy groups are methoxy and ethoxy groups, and the like.

The above described polar group is bonded directly or through a suitable bonding group to only the end of a polymer main chain containing at least one of the polymeric components represented by, at least, General Formulae (I), (Ia) and/or (Ib). These bonding groups include any combination of atomic groups, for example, carbon-carbon bond (single or double bond), carbon-hetero atom bond wherein hetero atom is, for example, oxygen sulfur, nitrogen or silicon atom, hetero atom-hetero atom bond.

A preferable structure of the end of the polymer main chain of Resin A or Resin A' according to the present invention is thus shown by the following General Formula (VI):

General Formula (VI)

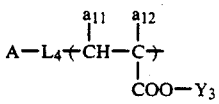

In Formula (VI), $a_{11}$ and $a_{12}$ have the same meaning as $a_1$ and $a_2$ in Formula (I), $Y_3$ has the same meaning as $R_1$ in Formula (I),

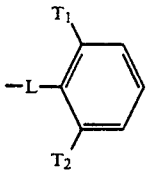

in Formula (Ia) or

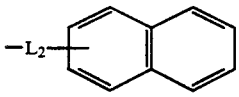

in Formula (Ib), A represents the above described specific polar group and $L_4$ has the same meaning as $L_3$ in General Formula (V) of the hydrophilic group-containing component in the hydrophilic resin.

The moiety represented by [A-$L_4$] in the above-described Formula (VI) will further be exemplified below without limiting the scope of the present invention. In the following examples, $k_1$ is an integer of 1 or 2, $k_2$ is an integer of 2 to 16 and $k_3$ is an integer of 1 or 3.

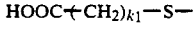
(c-1)

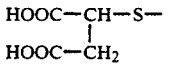
(c-2)

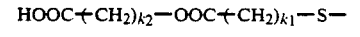
(c-3)

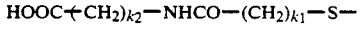
(c-4)

(c-5)

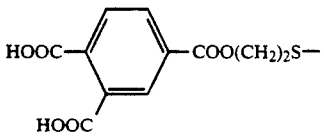

(c-6)

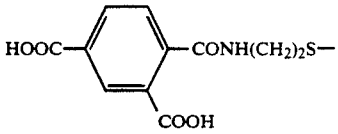

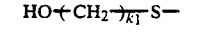
(c-7)

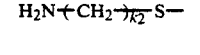
(c-8)

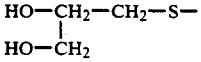
(c-9)

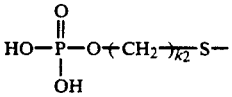
(c-10)

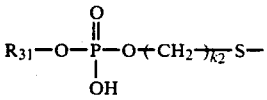
(c-11)

$R_{31}$: alkyl group of $C_{1-6}$

-continued $HO_3S(CH_2)_2S-$ (c-12)

(c-13)

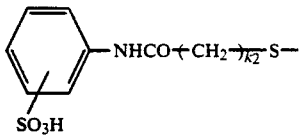

(c-14)

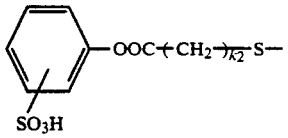

(c-15)

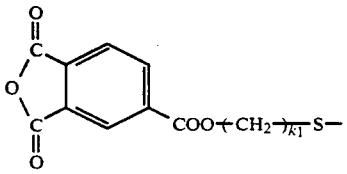

(c-16)

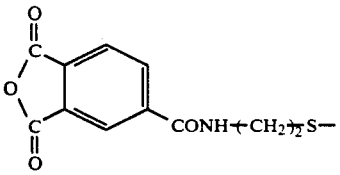

(c-17)

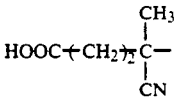

(c-18)

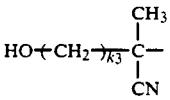

(c-19)

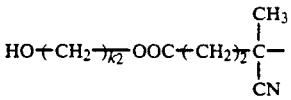

(c-19)

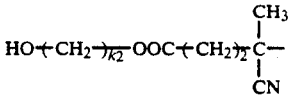

(c-20)

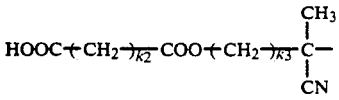

(c-21)

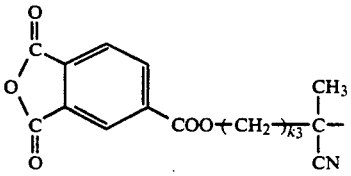

(c-22)

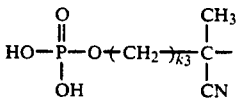

-continued (c-23)

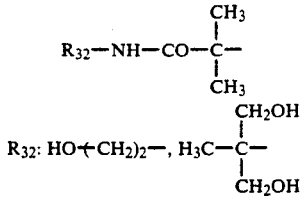

$R_{32}$: $HO(CH_2)_2-$, $H_3C-C(CH_2OH)_2-$ (c-24)

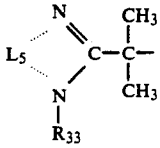

$L_5$: $(CH_2)_3-$, $(CH_2)_4-$, $-CH_2-CH(OH)-CH_2-$ $R_{33}$: $-H$, $-CH_2CH_2OH$ (c-25)

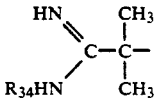

$R_{34}$: $-CH_2CH_2OH$,

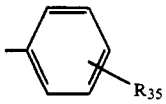

($R_{35}$: H, $-NH_2$, $-OH$)

(c-26)

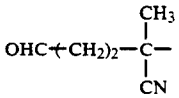

(c-27)

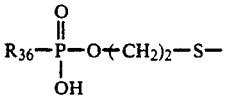

$R_{36}$: alkyl group of $C_{1-6}$ (c-28)

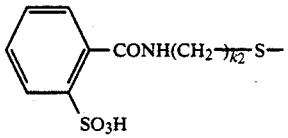

$HOOC(CH_2)_2-NH(CH_2)_{k1}-S-$ (c-29)

Resin A or Resin A' of the present invention can contain, in addition to the monomers of General Formulae (I), (Ia) and/or (Ib) and the monomers containing the polar groups, other monomers as copolymeric components.

As the other copolymeric components, for example, there are given methacrylic acid esters containing other substituents than those represented by General Formula (I), acrylic acid esters, crotonic acid esters, α-olefins, vinyl or allyl esters of carboxylic acids such as acetic acid, propionic acid, butyric acid, valeic acid, benzoic acid, naphthalene carboxylic acid and the like, acrylonitrile, methacrylonitrile, vinyl esters, itaconic acid esters such as dimethyl ester, diethyl ester and the like, acrylamide, methacrylamide, styrenes such as styrene, vinyltoluene, chlorostyrene, vinyltoluene, chlorostyrene, hydroxystyrene, N,N-dimethylaminomethylstyrene, methoxycarbonylstyrene, methanesulfonyloxystyrene, vinylnaphthalene and the like, vinylsulfone-containing compounds, vinyl ketone-containing compounds, heterocyclic vinyl compounds such as vinylpyrrolidone, vinylpyridine, vinylimidazole, vinylthiophene, vinylimidazoline, vinylpyrazole, vinyldioxane, vinylquinoline, vinyltetrazole, vinyloxazine and the like.

Synthesis of Resin A, i.e. copolymer consisting of the above-described copolymeric components and having the above described polar group at the end of the main chain can readily be carried out by a method comprising reacting the end of a living polymer obtained by the prior art anionic polymerization or cationic polymerization with various reagents (method by ionic polymerization), method comprising radical polymerization using a chain transfer agent and/or polymerization initiator containing a specific acid group in the molecule, method comprising subjecting a polymer containing a reactive group such as amino group, halogen atoms, epoxy group, acid halides group or the like at the end thereof, obtained by the ionic polymerization or radical polymerization as described above, to polymer reaction convert it into the specified polar group according to the present invention, for example, as described in introductions and literatures cited therein of P. Dreyfuss and R. P. Quirk, "Encycl. Polym. Sci. Eng." 7, 551 (1987); Yoshiki Nakajo and Yuya Yamashita, "Senryo to Yakuhin (Dyes and Chemicals)" 30, 232 (1985), Akira Ueda and Susumu Nagai "Kagaku to Kogyo (Science and Industry)" 60, 57 (1986), etc.

As the chain transfer agent, for example, there can be used mercapto compounds having the above-described polar group or reactive group capable of being converted into the polar group, such as thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid; 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propane diol, 1-mercapto-2-propanol, 3-mercapto-2-butanol, mercaptophenol, 2-mercaptoethylamine, 2-mercaptoimidazole, 2-mercapto-3-pyridinol, 4-(2-mercaptoethyloxycarbonyl)phthalic anhydride, 2-mercaptoethylphosphono acid, 2-mercaptoethylphosphono acid monomethyl ester and the like, and iodoalkyl compounds having the above described polar group or substituent, such as iodoacetic acid, iodopropionic acid, 2-iodoethanol, 2-iodoethanesulfonic acid, 3-iodopropanesulfonic acid and the like. Above all, the mercapto compounds are preferably used.

As the polymerization initiator containing the polar group or the specified reactive group capable of being converted into the polar group, for example, 4,4'-azobis(4-cyanovaleic acid), 4,4'-azobis(4-cyanovaleic acid chloride), 2,2'-azobis(2-cyanopropanol), 2,2'-azobis(2-cyanopentanol), 2,2'-azobis[2-methyl-N-(2-hydroxyethyl)-propionamide], 2,2'-azobis{2-methyl-N-[1,1-bis(hydroxymethyl)-2-hydroxyethyl]propionamide}, 2,2'-azobis{2-[1-(2-hydroxyethyl)-2-imidazoline-2-il]propane}, 2,2'-azobis[2-(2-imidazoline-2-il)propane] and 2,2'-azobis[2-(4,5,6,7-tetrahydro-1H-1,3-diazepine-2-il)propane].

These chain transfer agents or polymerization initiators are generally used in a proportion of 0.5 to 15 parts by weight, preferably 2 to 10 parts by weight to 100 parts by weight of all the monomers.

Resin B will be illustrated. Resin B consists of a comb type copolymer having a weight average molecular weight of $3\times10^4$ to $1\times10^6$, preferably $5\times10^4$ to $5\times10^5$ and being obtained by copolymerizing a monofunctional macromonomer containing at least one of polymeric components represented by General Formulae (IIa) and (IIb) and a polymerizable double bond group represented by General Formula (IIc) at the terminal of the polymer main chain with a monomer represented by General Formula (III). The glass transition point of Resin B is in the range of preferably 0° to 110°, more preferably 20° to 90°.

If the molecular weight of Resin B is less than $3\times10^4$, the film strength cannot be maintained sufficient, while if more than $1\times10^6$, the dispersibility is deteriorated, the film smoothness is lowered, the image quality of a reproduced image, in particular, reproducibility of fine lines and letters is deteriorated and background staining is remarkable when used as an offset master The polar group content in Resin B' is preferably at most 5% by weight, more preferably at most 2% by weight to 100% by weight of resin B', since if more than 5% by weight, there occurs aggregation or precipitation of the dispersion for forming the light-sensitive layer, or the dispersibility is lowered to thus deteriorate the film smoothness and electrophotographic properties.

Firstly, the copolymeric component of the comb type copolymer, Resin B, i.e. macromonomer M will be illustrated in detail. The monofunctional macromonomer M is a compound having a polymerizable double bond group represented by General Formula (IIc), bonded to only one end of a polymer main chain containing at least one of polymeric components represented by General Formula (IIa) or (IIb), and having a weight average molecular weight of at most $2\times10^4$:

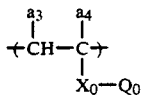
General Formula (IIa)

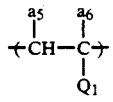
General Formula (IIb)

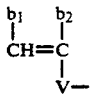
General Formula (IIc)

In General formulae (IIa), (IIb) and (IIc), the hydrocarbon groups contained in $a_3$, $a_4$, $a_5$, $a_6$, $b_1$, $b_2$, $X_0$, $Q_0$ and $Q_1$ respectively have the number of carbon atoms, as described above, in the form of the non-substituted hydrocarbon groups and optionally can be substituted.

In General Formula (IIc) representative of the polymerizable property of the macromonomer M, V represents —COO—, —OCO—, $-(CH_2)_1-OCO-$, $-(CH_2)_1-COO-$, —O—, —CONHCOO—, —CONHCONH—, $-SO_2-$, —CO—,

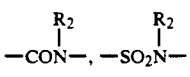

wherein $R_2$ represents hydrogen atom or hydrocarbon group or

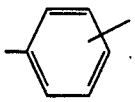

In these formulae, l represents an integer of 1 to 3 and $R_2$ has the same meaning as $R_{19}$ in General Formula (V) when $R_2$ is a hydrocarbon group.

When V is

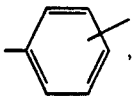

the benzene ring can have a substituent illustrative of which are halogen atoms such as chlorine and bromine atoms, alkyl groups such as methyl, ethyl, propyl, butyl, chloromethyl, methoxymethyl groups and the like, and alkoxy groups such as methoxy, ethoxy, propioxy, butoxy and the like.

$b_1$ and $b_2$ each represent preferably, same or different, hydrogen atom, halogen atoms such as chlorine and bromine atoms, cyano group, alkyl groups containing 1 to 4 carbon atoms such as methyl, ethyl, propyl, butyl and the like, —$COOR_3$ and —$COOR_3$ through a hydrocarbon group, wherein $R_3$ represents hydrogen atom, alkyl group containing 1 to 18 carbon atoms, alkenyl group, aralkyl group, alicyclic group or aryl group, which can be substituted, and specifically, has the same meaning as $R_{19}$ in General Formula (V).

Examples of the hydrocarbon group in the —COO—$R_3$ group through a hydrocarbon group are methylene, ethylene, propylene groups and the like.

In General Formula (IIc), more preferably, V represents —COO—, —OCO—, —$CH_2OCO$—, —$CH_2COO$—, —O—, —CONH—, —CONHCOO—, —$SO_2NH$— or

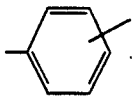

$b_1$ and $b_2$ each represent, same or different, hydrogen atom, methyl group, —$COOR_3'$ or —$CH_2COOR_3'$ wherein $R_3'$ represents hydrogen atom or an alkyl group containing 1 to 6 carbon atoms such as methyl ethyl, propyl, butyl, hexyl group or the like. More preferably, one of $b_1$ and $b_2$ is surely hydrogen atom.

In General Formula (IIa) representing the copolymeric component to be the recurring unit contained in the macromonomer M, $X_0$ has the same meaning as V in the foregoing Formula (IIc), $a_3$ and $a_4$ each have the same meaning as $a_1$ and $a_2$ in Formula (I), which can be same or different, and $Q_0$ represents an aliphatic group containing 1 to 18 carbon atoms or an aromatic group containing 6 to 12 carbon atoms and specifically represents the same meaning as $R_1$ in Formula (I).

When $Q_0$ is an aliphatic group, more preferably, it represents an alkyl group containing 1 to 5 carbon atoms, alkenyl group containing 3 to 6 carbon atoms and aralkyl group containing 7 to 9 carbon atoms, and when $Q_0$ is an aromatic group, it includes all the examples described above.

In Formula (IIa), preferably $X_0$ represents —COO—, —OCO—, —$CH_2OCO$—, —$CH_2COO$—, —O—, —CO—, —CONH—, —$SO_2NH$— or

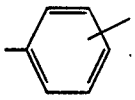

In General Formula (IIb) representing the copolymeric component to be the recurring unit contained in the macromonomer M, $Q_1$ represents —CN, —$CONH_2$ or

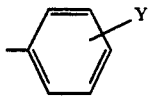

and examples of Y are halogen atoms such as chlorine and bromine atoms, alkyl groups such as methyl, ethyl, propyl, butyl, chloromethyl, methoxymethyl groups and the like and alkoxy groups such as methoxy, ethoxy, propioxy, butoxy groups and the like, which are the same as the examples of the substituents when V in Formula (IIc) is

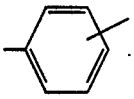

The macromonomer M can contain two or more polymeric components represented by Formula (IIa) or (IIb). In Formula (IIa), when $Q_0$ is an aliphatic group, the aliphatic group containing 6 to 12 carbon atoms is preferably in a proportion of less than 20% by weight of all the polymeric components in the macromonomer M.

Furthermore, when $X_0$ represent —COO— in General Formula (IIa), the polymeric component represented by General Formula (IIa) is preferably contained in a proportion of at least 30% by weight in all the polymeric components in the macromonomer M.

In the macromonomer M, as the monomer corresponding to the recurring unit copolymerizable with the polymeric component represented by General Formula (IIa) and/or (IIb), there can be used those similar to exemplified as the other monomer which can be contained as the copolymeric component with the monomer represented by General Formula (Ia) and/or (Ib) and the monomer containing the polar group of Resin A.

In the present invention, the macromonomer M has such a chemical structure that the polymerizable double bond group represented by General Formula (IIc) is bonded directly or through a suitable bonding group to only one end of the polymer main chain consisting of the recurring units represented by General Formulae (IIa) and/or (IIb). The bonding group of the component of Formula (IIa) and the component of Formula (IIa) or (IIb) includes carbon-carbon bond (single or double bond), carbon-hetero atom (hetero atom being, for example, sulfur, oxygen, nitrogen, silicon atoms, etc.) and hetero atom-hetero atom in suitable combination.

A preferable example of the macromonomer M of the present invention is as represented by the following General Formula (VII):

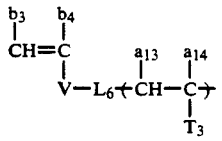

General Formula (VII)

in which $a_{13}$ and $a_{14}$ each have the same meaning as $a_3$ and $a_4$ or $a_5$ and $a_6$ in Formula (IIa) or (IIb), i.e. $a_1$ and $a_2$ in Formula (I), $b_3$ and $b_4$ each have the same meaning as $b_1$ and $b_2$ in Formula (IIc), V has the same meaning as V in Formula (IIc), $T_3$ represents $-X_0-Q_0$ in Formula (IIa) or $-Q_1$ in Formula (IIb) and $L_6$ has the same meaning as $L_3$ in Formula (V).

Examples of the recurring unit represented by General Formula (IIa) or (IIb), contained as the copolymeric component in the macromonomer M of the present invention, are given below without limiting the scope of the present invention. In the following units (d-1) to (d-21), $R_{37}$ represents $-C_nH_{2n+1}$ (n: integer of 1 to 6), a represents —H or $-CH_3$ and $k_4$ represents an integer of 2 to 10.

(d-1)

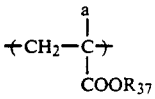

(d-2)

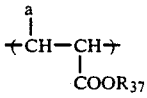

(d-3)

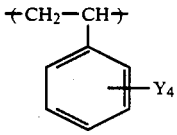

$Y_4$: —H, $-CH_3$, —Cl, —Br (d-4)

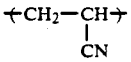

(d-5)

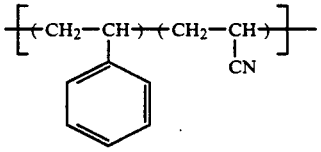

(d-6)

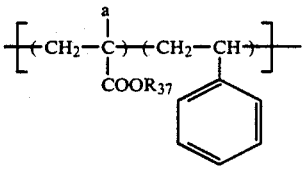

(d-7)

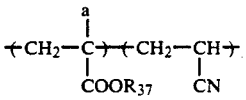

-continued (d-8)

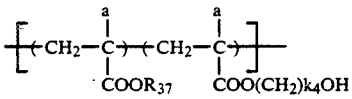

(d-9)

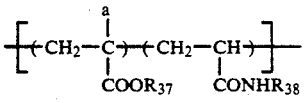

$R_{38}$: —H, $-C_nH_{2n+1}$ (n is 1 to 6)

(d-10)

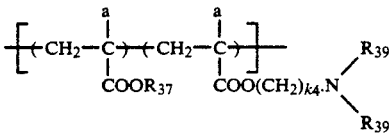

$R_{39}$: $-CH_3$, $-C_2H_5$, $-C_3H_7$, $(CH_2)_2Cl$, $(CH_2)_2CN$ (d-11)

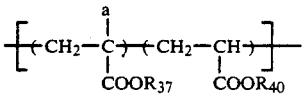

$R_{40}$: $-CH_3$, $-C_2H_5$ (d-12)

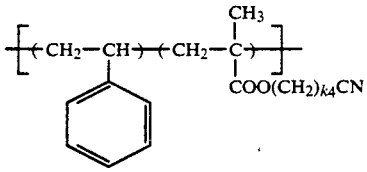

(d-13)

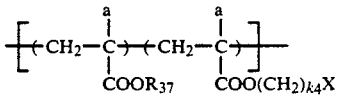

X: —Cl, —Br, —F (d-14)

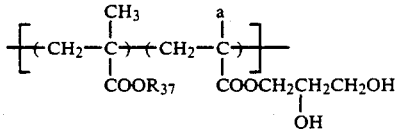

(d-15)

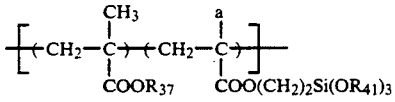

$R_{41}$: $-CH_3$, $-C_2H_5$, $-C_3H_7$, $-C_4H_9$ (d-16)

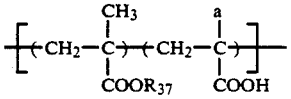

(d-17)

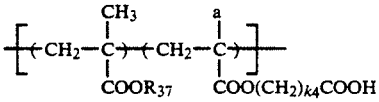

(d-18)

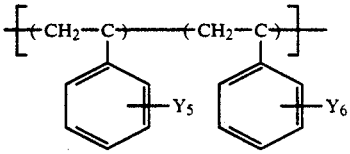

$Y_5$: —H, $-CH_3$ $Y_6$: —COOH, $-SO_3H$, $-CH_2OH$

-continued
(d-19)
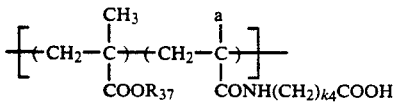
(d-20)
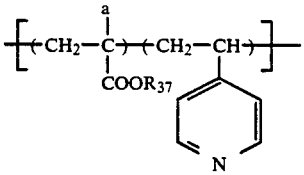
(d-21)
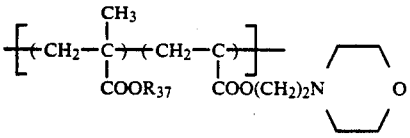
Examples of the macromonomer M of the present invention, represented by General Formula (VII), are given below without limiting the scope of the present invention. In the following compounds (e-1) to (e-31), b represents —H or —$CH_3$, n represents an integer of 1 to 12 and m represents an integer of 2 to 12.
(e-1)
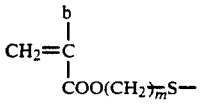
(e-2)
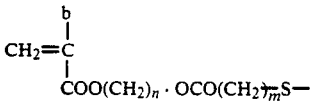
(e-3)
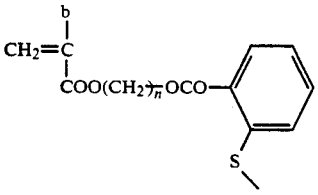
(e-4)
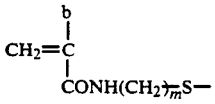
(e-5)
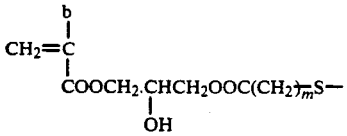
(e-6)
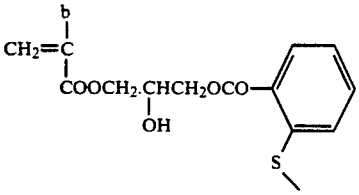
-continued
(e-7)
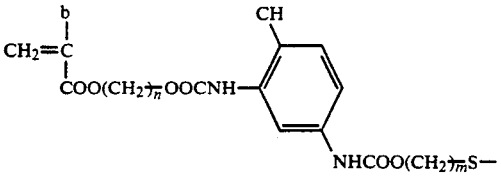
(e-8)
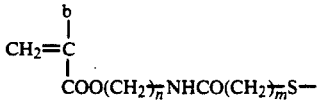
(e-9)
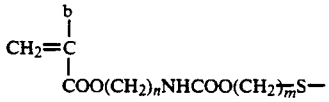
(e-10)
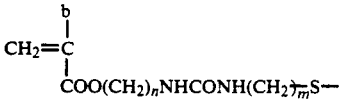
(e-11)
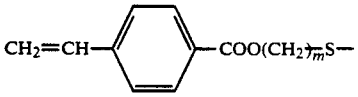
(e-12)
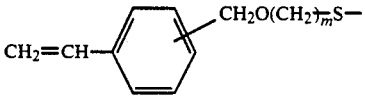
(e-13)
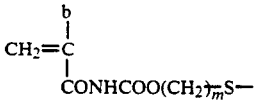
(e-14)
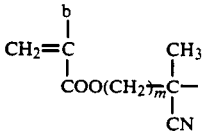
(e-15)
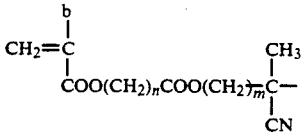
(e-16)
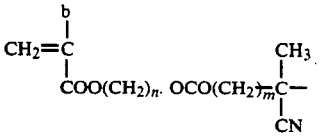
(e-17)
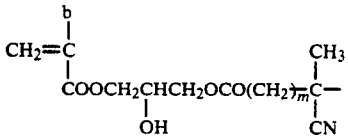
(e-18)
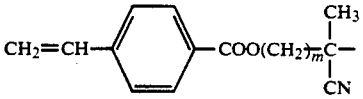

-continued (e-19)

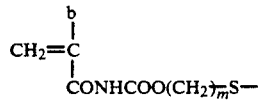

(e-20)

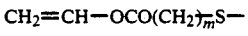

(e-21)

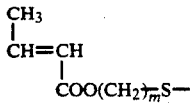

(e-22)

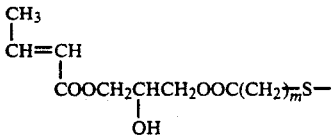

(e-23)

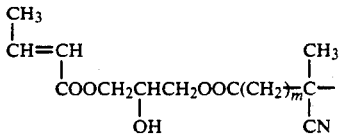

(e-24)

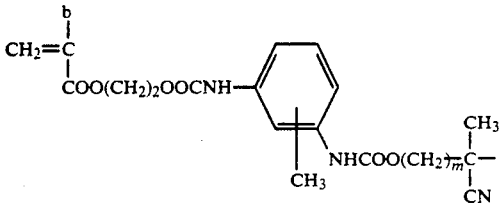

(e-25)

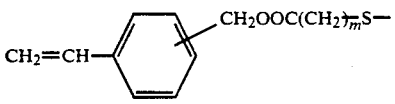

(e-26)

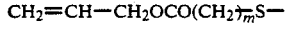

(e-27)

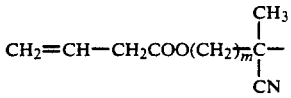

(e-28)

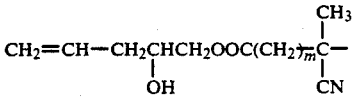

(e-29)

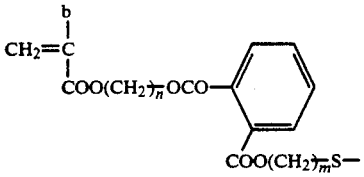

(e-30)

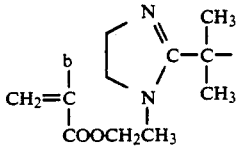

-continued (e-31)

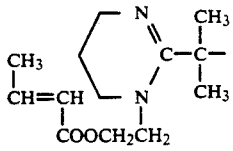

The macromonomer M of the present invention can be prepared by the known synthesis methods, for example, an ionic polymerization method comprising reacting the end of a living polymer obtained by anionic or cationic polymerization with various reagents to obtain a macromer, a radical polymerization method comprising reacting a reactive group-terminated oligomer obtained by radical polymerization using a polymerization initiator and/or chain transfer agent containing a reactive group such as carboxyl, hydroxyl or amino group in the molecule with various reagents to obtain a macromer, a polyaddition-condensation method comprising subjecting an oligomer obtained by polyaddition or polycondensation to the radical polymerization as described above to introduce a polymerizable double bond group therein.

These methods are described, for example, in introductions and literatures cited therein of P. Dreyfuss & R. P. Quirk, "Encycl. Polym. Sci. Eng.", 7, 551 (1987), P. F. Rempp E. Franta, "Adu., Polym. Sci." 58, 1 (1984), V. Percec, "Appl. Polym. Sci." 285, 95 (1984), R. Asami and M, Takagi, "Makromol. Chem. Suppl." 12, 163 (1985), P. Rempp. et al., "Makromol. Chem. Suppl." 8, 3 (1984), Yusuke Kawakami, "Kagaku Kogyo (Chemical Industry)" 38, 56 (1987), Yuya Yamashita, "Kobunshi (macromolecules)" 31, 988 (1982), Shiro Kobayashi, "Kobunshi (Macromolecules)" 30, 625 (1982), Toshinobu Higashimaru, "Nippon Secchaku Kyokai-shi (Japan Adhesive Association)" 18, 536 (1982), "Kobunshi Kako (Macromolecule Processing)" 35, 262 (1986), Shiro Toki and Takashi Tsuda "Kino Zairyo (Functional Materials)" 1987, No. 10, 5, etc.

The monomer represented by General Formula (III), which is to be the copolymeric component of the comb type polymer with the above described macromonomer, will be illustrated in detail:

In General Formula (III), $X_1$ has the same meaning as $X_o$ in Formula (IIa) and preferably represents —COO—, —OCO—, —$CH_2$OCO—, —$CH_2$COO—, —O— or

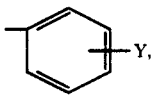

$Q_2$ has the same meaning as $Q_o$ in Formula (IIa) and represents specific and preferable examples, same as those illustrated in $Q_o$ and $a_7$ and $a_8$ each represent, same or different, those defined as $a_1$ and $a_2$ in Formula (I). Preferably, any one of $a_7$ and $a_8$ represents hydrogen atom.

The foregoing comb type copolymer can further contain, in addition to the monomer represented by General Formula (III), other monomers copolymerizable with this monomer. The other monomers specifically include those illustrated as the other monomers to be copolymerized with the polymeric components represented by General Formulae (IIa) and/or (IIb) of the macromonomer M. These are also similar to the other monomers which can be contained with the copoloymeric components represented by General Formulae (I), (Ia) and (Ib) in Resin A. In the comb type copolymer, the other monomers are preferably in a proportion of at most 30% by weight of all the polymeric components.

Further, the comb type copolymer of Resin B according to the present invention can contain a specific polar group bonded to only one end of the o polymer chain (Resin B').

Examples of the polar group are $-PO_3H_2$, $-SO_3H$, $-COOH$, $-OH$, $-SH$,

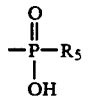

wherein $R_5$ represents a hydrocarbon group or $-OR_5'$ wherein $R_5'$ represents a hydrocarbon group, cyclic acid anhydride-containing groups, $-CHO$, $-CONH_2$, $-SO_2NH_2$ and

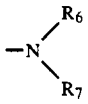

wherein $R_6$ and $R_7$ each represents, same or different, hydrogen atom or a hydrocarbon group. Preferable examples thereof are $PO_3H_2$, $-SO_3H$, $-COOH$ and

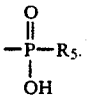

The content of

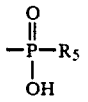

is the same as defined in the components containing the polar groups of Resin A.

The polar group is chemically bonded directly or through a suitable bonding group to one end of the polymer main chain. The group for bonding the polymer main chain and polar group is composed of carbon-carbon bond (single or double bond), carbon-hetero atom bond (hetero atom: oxygen, sulfur, nitrogen silicon atoms, etc.) and hetero atom-hetero atom, in suitable combination.

Of the comb type copolymer containing the specified polar group bonded to one end of the polymer main chain, preferable examples are as represented by General Formula (VIIIa) or (VIIIb):

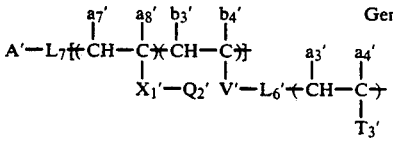

General Formula (VIIIa)

-continued

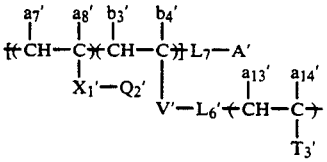

General Formula (VIIIb)

In General Formulae (VIIIa) and (VIIIb), $a_7'$, $a_8'$, $X_1'$ and $Q_2'$ respectively have the same meanings as the corresponding $a_7$, $a_8$, $X_1$ and $Q_2$ in formula (III), represented as the polymeric component in Resin B, and $a_{13}'$, $a_{14}'$, $b_3'$, $b_4'$, $\bar{v}'$, $L_6'$ and $T_3'$ respectively have the same meanings as the corresponding $a_{13}$, $a_{14}$, $b_3$, $b_4$, V, $L_6$ and $T_3$ in Formula (VII), represented as the preferable macromonomer. A' represents the foregoing polar group bonded to the end of the polymer main chain. $L_7$ represents a mere bond or group for bonding the specific polar group (A') and polymer main chain and specifically represents the same content as $L_4$ in Formula (VI) representing the terminal structure of Resin A. Furthermore, examples of A'-$L_7$ are the same as those of A-$L_4$-described in Formula (VI).

Preferably, the comb type copolymer having the specific polar group bonded to the end of the polymer main chain, that is, Resin B' does not contain copolymeric components containing polar groups such as phosphono, carboxyl, sulfo, hydroxyl, formyl, amino,

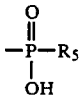

and the like.

Production of the comb type polymer B' having the specific polar group bonded to only one end of the polymer chain can readily be carried out in known manner, for example, by the similar method to illustrated in the case of Resin A. However, the weight average molecular weight of the polymer can be adjusted to $3\times10^4$ or more by controlling the variety and quantity of a polymerization initiator, the polymerization initiating speed and the quantity of a chain transfer agent. For example, the quantity of a chain transfer agent or polymerization initiator containing the specific polar group according to the present invention is preferably 0.05 to 5 parts by weight, more preferably 0.1 to 2 parts by weight per 100 parts by weight of all the monomers.

In the present invention, other resins can jointly be used in addition to Resin A including Resin A' and Resin B including Resin B' according to the present invention. Examples of the other resins are alkyd resins, polybutyral resins, polyolefin resins, ethylene-vinyl acetate copolymers, styrene resins, styrene-butadiene resins, acrylatebutadiene resins, alkanic acid vinyl resins and the like.

When the quantity of the above described other resin exceeds 30% by weight of the whole quantity of the binder resin comprising the resins of the present invention, the benefits of the present invention, in particular, improvement of the static property will be lost.

The proportion of Resin A including Resin A' and Resin B including Resin B', depending upon the grain diameter and surface state of photoconductive zinc oxide used, is generally in the range of 5-80 to 95-20 (by weight), preferably 10-60 to 90-40 (by weight).

The quantity of the binder resin used for photoconductive zinc oxide is generally in a proportion of 10 to 100 parts by weight of the binder resin, preferably 15 to 50 parts by weight to 100 parts by weight of the photoconductive zinc oxide.

In the present invention, if necessary, various coloring matters or dyes can be used as a spectro sensitizer, illustrative of which are carbonium dyes, diphenylmethane dyes, triphenylmethane dyes, xanthene dyes, phthalein dyes, polymethine dyes such as oxonol dyes, merocyanine dyes, cyanine dyes, rhodacyanine dyes, styryl dyes, etc. and phthalocyanine dyes which can contain metals, as described in Harumi Miyamoto and Hidehiko Takei "Imaging" No. 8, page 12 (1973), C. Y. Young et al. "RCA Review" 15, 469 (1954), Kohei Kiyota et al. "Denki Tsushin Gakkai Ronbunshi" J63-C (No. 2), 97 (1980), Yuji Harasaki et al. "Kogyo Kagaku Zasshi" 66, 78 and 188 (1963) and Tadaaki Tani "Nippon Shashin Gakkaishi" 35, 208 (1972).

For example, those using carbonium dyes, triphenylmetahe dyes, xanthene dyes or phthalein dyes are described in Japanese Patent Publication No. 452/1976, Japanese Patent Laid-Open Publication Nos. 90334/1975, 114227/1975, 39130/1978, 82353/1978 and 16456/1982 and U.S. Pat. Nos. 3,052,540 and 4,054,450.

As the polymethine dyes such as oxonol dyes, merocyanine dyes, cyanine dyes and rhodacyanine dyes, there can be used dyes described in F. M. Harmmer "The Cyanine Dyes and Related Compounds" and specifically dyes described in U.S. Pat. Nos. 3,047,384, 3,110,591, 3,121,008, 3,125,447, 3,128,179, 3,132,942 and 3,622,317; British Patent Nos. 1,226,892, 1,309,274 and 1,405,898; and Japanese Patent Publication Nos. 7814/1973 and 18892/1980.

The polymethine dyes capable of spectrally sensitizing near infrared radiations to infrared radiations with longer wavelengths of at least 700 nm are described in Japanese Patent Publication No. 41061/1976; Japanese Patent Laid-Open Publication Nos. 840/1972, 44180/1972, 5034/1974, 45122/1974, 46245/1982, 35141/1981, 157254/1982, 26044/1986 and 27551/1986; U.S. Pat. Nos. 3,619,154 and 4,175,956; and "Research Disclosure" 216, pages 117-118 (1982).

The photoreceptor of the present invention is excellent in that its performance is hardly fluctuated even if it is used jointly with various sensitizing dyes. Furthermore, various additives for electrophotographic light-sensitive layers, such as chemical sensitizers, well known in the art can jointly be used as occasion demands, for example, electron accepting compounds such as benzoquinone, chloranil, acid anhydrides, organic carboxylic acids and the like, described in the foregoing "Imaging" No. 8, page 12 (1973) and polyarylalkane compounds, hindered phenol compounds, p-phenylenediamine compounds and the like, described in Hiroshi Komon et al. "Latest Development and Practical Use of Photoconductive Materials and Light-Sensitive Materials (Saikin no Kododenzairyo to Kankotai no Kaihatsu to Jitsuyoka)" Sections 4 to 6, published by Nippon Kagaku Joho Shuppanbu (1986).

The amounts of these additives are not particularly limited, but are generally 0.0001 to 2.0 parts by weight based on 100 parts by weight of the photoconductive zinc oxide.

The thickness of the photoconductive layer is generally 1 to 100 μm, preferably 10 to 50 μm.

When in a photoreceptor of laminate type consisting of a charge generating layer and charge transporting layer, a photoconductive layer is used as the charge producing layer, the thickness of the charge producing layer is generally 0.01 to 1 μm, preferably 0.05 to 0.5 μm.

In the present invention, an insulating layer can be provided for the purpose of mainly protecting the photoreceptor and improving the durability and dark decay property, during which the insulating layer has a relatively small thickness. In the case of using the photoreceptor for a specific electrophotographic process, on the other hand, a relatively thick insulating layer is provided, preferably with a thickness of 5 to 70 μm, particularly 10 to 50 μm.

As the charge transporting material of the laminate type photoreceptor, there are preferably used polyvinylcarbazole, oxazole, dyes, pyrazoline dyes, triphenylmethane dyes and the like. The charge transporting layer has generally a thickness of 5 to 40 μm, preferably 10 to 30 μm.

Typical examples of the resin used for forming the insulating layer or charge transporting layer are themoplastic resins and thermosetting resins such as polystyrene resins, polyester resins, cellulose resins, polyether resins, vinyl chloride resins, vinyl acetate resins, vinyl chloride-vinyl acetate copolymer resins, polyacrylic resins, polyolefin resins, urethane resins, epoxy resins, melamine resins and silicone resins.

The photoconductive layer of the present invention can be provided on a support as well known in the art. Generally, a support for an electrophotographic light-sensitive layer is preferably electroconductive and as the electroconductive support, there can be used, as known in the art, metals or substrates such as papers, plastic sheets, etc. which are made electroconductive by impregnating low resistance materials therein, substrates whose back surface, opposite to the surface to be provided with a light-sensitive layer, is made electroconductive, which is further coated with at least one layer for the purpose of preventing it from curling; the above described support provided with, on the surface thereof, a water proof adhesive layer; the above described support optionally provided with, on the surface layer, one or more pre-coat layer; and papers laminated with plastics which are made electroconductive, for example, by vapor deposition of Al or the like thereon. Examples of the substrates or materials which are electroconductive or made electroconductive are described in Yukio Sakamot "Electrophotography (Denshi Shashin)" 14 (No. 1), pages 2 to 11 (1975), Hiroyuki Moriga "Introduction to Chemistry of Special Papers (Nyumon Tokushushi no Kagaku)" Kobunshi Kankokai (1975), M. F. Hoover "J. Macromol. Sci. Chem." A-4 (6), pp. 1327-1417 (1970), etc.

Production of a lithographic printing plate using the electrophotographic lithographic printing plate precursor of the present invention can be carried out in known manner. That is, the electrophotographic lithographic printing plate precursor is electrostatically charged substantially uniformly in a dark place and imagewise exposed to form an electrostatic latent image by an exposing method, for example, by scanning exposure using a semiconductor laser, He-Ne laser, etc., by reflection imagewise exposure using a xenon lamp, tungsten lamp, fluorescent lamp, etc. as a light source or by contact exposure through a transparent positive film. The resulting electrostatic latent image is developed with a toner by any of various known development methods, for example, cascade development, magnetic brush development, powder cloud development, liquid development, etc. Above all, the liquid development method capable of forming a fine image is particularly suitable for making a printing plate. The thus formed toner image can be fixed by a known fixing method, for example, heating fixation, pressure fixation, solvent fixation, etc.

The printing plate having the toner image, formed in this way, is then subjected to a processing for rendering hydrophilic the non-image area in conventional manner using the so-called oil-desensitizing solution. The oil-desensitizing solution of this kind include processing solutions containing, as a predominant component, cyanide compounds such as ferrocyanides or ferricyanides, cyanide-free processing solutions containing, as a predominant component, ammine cobalt complexes, phytic acid or its derivatives or guanidine derivatives, processing solutions containing, as a predominant component, organic acids or inorganic acids capable of forming chelates with zinc ion, and processing solutions containing water-soluble polymers.

For example, the cyanide compound-containing processing solutions are described in Japanese Patent Publication Nos. 9045/1969 and 39403/1971 and Japanese Patent Laid-Open Publication Nos. 76101/1977, 107889/1982 and 117201/1979. The phytic acid or its derivatives-containing processing solutions are described in Japanese Patent Laid-Open Publication Nos. 83807/1978, 83805/1978, 102102/1978, 109701/1978, 127003/1978, 2803/1979 and 44901/1979. The metal complex, e.g., cobalt complex-containing processing solutions are described in Japanese Patent Laid-Open Publication Nos. 104301/1978, 140103/1978 and 18304/1979 and Japanese Patent Publication No. 28404/1968. The inorganic acid- or organic acid-containing processing solutions are described in Japanese Patent Publication Nos. 13702/1964, 10308/1965, 28408/1968 and 26124/1965 and Japanese Patent Laid-Open Publication No. 118501/1976. The guanidine compound-containing processing solutions are described in Japanese Patent Laid-Open Publication No. 111695/1981. The water-soluble polymer-containing processing solutions are described in Japanese Patent Laid-Open Publication Nos. 36402/1974, 126302/1977, 134501/1977, 49506/1978, 59502/1978 and 104302/1978 and Japanese Patent Publication Nos. 9665/1963, 22263/1964, 763/1965 and 2202/1965.

The oil-desensitizing treatment can generally be carried out at a temperature of about 10° C. to about 50° C., preferably from 20° C. to 35° C., for a period of not longer than about 5 minutes.

In any of the above described oil-desensitizing solutions, the zinc oxide in the surface layer as the photoconductive is ionized to be zinc ion which causes a chelation reaction with a compound capable of forming a chelate in the oil-desensitizing solution to form a zinc chelate compound. This is precipitated in the surface layer to render the non-image area hydrophilic.

Thus, the printing plate precursor of the present invention can be converted into a printing plate by the oil-desensitizing processing with an oil-desensitizing solution.

The present invention will now be illustrated in greater detail by way of examples, but it should be understood that the present invention is not limited thereto.

EXAMPLES

Preparation Example 1 of Hydrophilic Resin Grains

A mixed solution of 95 g of dodecyl methacrylate, 5 g of acrylic acid and 200 g of toluene was heated to 70° C. while stirring under a nitrogen stream, and 1.5 g of azobis(isobutyronitrile) (referred to as A.I.B.N.) was added thereto and reacted for 8 hours. To this reaction mixture were added 12 g of glycidyl methacrylate, 1 g of t-butylhydroquinone and 0.8 g of N,N-dimethyldodecylamine, followed by allowing the mixture to react at 100° C. for 15 hours (Dispersed Resin $\alpha$).

A mixture of 7.5 g (as solid content) of the above described Dispersed Resin $\alpha$, 50 g of 2-hydroxyethyl methacrylate and 200 g of n-heptane was heated to 65° C. while stirring under a nitrogen stream, and 0.7 g of 2,2-azobis(isovaleronitrile) (referred to as A. I. V. N.) was then added thereto and reacted for 6 hours.

After passage of 20 minutes from the addition of the initiator (A. I. V. N.), the homogeneous solution became slightly opaque, the reaction temperature being raised to 90° C. After cooling, the reaction product was passed through a nylon cloth of 200 mesh to obtain a white dispersion having an average grain diameter of 0.19 $\mu$m as a white latex.

Preparation Example 2 of Resin Grains

A mixture of 50 g of 2-phosphonoethyl methacrylate, 8 g of Dispersed Resin $\alpha$ (as solid content), 150 g of ethyl acetate and 200 g of n-hexane was heated to 55° C. while stirring under a nitrogen stream, and 0.5 g of A. I. V. N. was added thereto and reacted for 4 hours, thus obtaining a white dispersion. After cooling, the reaction product was passed through a nylon cloth of 200 mesh. The resulting dispersion was a latex with an average grain diameter of 0.45 $\mu$m.

Preparation Example 3 of Resin Grains

Preparation Example 1 was repeated except using a mixture of 50 g of N-vinylpyrrolidone, 10 g of Dispersed Resin $\alpha$ (as solid content) and 200 g of toluene, thus obtaining a white latex with an average grain size of 0.30 $\mu$m.

Preparation Example 4 of Resin Grains

A mixture of 31.5 g of ethylene glycol, 51.8 g of phthalic anhydride, 6.0 g of methacrylic acid, 10 g of trichloroethylene and 0.7 g of p-toluenesulfonic acid was heated and reacted for 6 hours in such a manner that the reaction temperature was raised from 107° C. to 150° C. in 6 hours, while removing water byproduced by the reaction by the Dean-Stark method.

A mixture of 6 g of methacrylic acid, 76 g of chloroform, 11.6 g of ethanol and 5.8 g of Dispersed Resin $\beta$ obtained by the above described reaction (as solid content) was then refluxed under a nitrogen stream. 0.8 g of A. I. B. N. was then added thereto and reacted for 3 hours to obtain a white dispersion, latex with an average grain diameter of 0.40 $\mu$m.

Preparation Example 5 of Resin Grains

Preparation Example 1 was repeated except using a mixture of 50 g of N,N-dimethylaminoethyl methacrylate, 15 g of poly(dodecyl methacrylate) and 300 g of toluene, thus obtaining a white dispersion with an average grain diameter of 0.28 $\mu$m.

Preparation Example 6 of Resin Grains

A mixture of 10 g of (2-hydroxyethyl acrylate/-methyl methacrylate) copolymer (weight ratio 1/1) powder, 2 g of (dodecyl methacrylate/acrylic acid) copolymer (weight ratio 95/5) and 100 g of toluene was ball milled for 48 hours to obtain a dispersion, i.e. latex with an average grain diameter of 0.38 μm.

Preparation Example 7 of Resin Grains

A mixture of 10 g of (vinyl alcohol/methacrylic acid) copolymer (weight ratio 7/3), 1.8 g of (decyl methacrylate/N,N-dimethylaminoethyl acrylate) copolymer weight ratio 95/5) and 100 g of toluene was ball milled for 56 hours to obtain a dispersion, latex with an average grain diameter of 0.32 μm.

Preparation Example 8 of Resin Grains

Preparation Example 1 was repeated except adding 1 g of ethylene glycol dimethacrylate to Dispersed Resin α in addition to the 2-hydroxyethyl methacrylate and n-heptane, thus obtaining latex grains with an average grain diameter of 0.25 μm.

Preparation Example 9 of Resin Grains

Preparation Example 2 was repeated except adding 1.2 g of divinylbenzene to Dispersed Resin α in addition to the 2-phosphonoethyl methacrylate, ethyl acetate and n-hexane, thus obtaining latex grains with an average grain diameter of 0.40 μm.

Preparation Example 10 of Resin Grains

Preparation Example 3 was repeated except adding 1.5 g of ethylene glycol dimethacrylate to Dispersed Resin α in addition to the N-vinylpyrrolidone and toluene, thus obtaining latex grains with an average grain diameter of as that of Preparation Example 3.

Preparation Example 11 of Resin Grains

Preparation Example 4 was repeated except adding 0.05 g of 1,6-hexane diol diacrylate to Dispersed Resin β in addition to the methacrylic acid, chloroform and ethanol, thus obtaining latex grains with an average grain diameter of 0.45 μm.

Preparation Example 12 of Resin Grains

Preparation Example 5 was repeated except adding 0.8 g of triethylene glycol dimethacrylate, thus obtaining latex grains with an average grain diameter of 0.43 μm.

Preparation Example 13 of Resin Grains

A mixed solution of 50 g of the following monomer (a), 30 g of methyl methacrylate, 17 g of 2-hydroxyethyl methacrylate, 3 g of allyl methacrylate and 300 g of tetrahydrofuran was heated to 80° C. under a nitrogen stream. 1.5 g of A. I. B. N. was added thereto and reacted for 6 hours, then subjected to reprecipitation in hexane and filtering to obtain a solid product, which was then dried, thus obtaining 84 g of a powder.

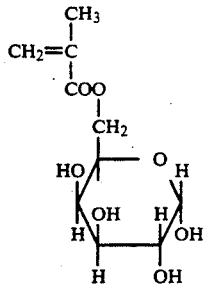

Monomer(a)

Preparation Example 14 of Resin Grains

A mixture of 50 g of (2-hydroxypropyl methacrylate/ethyl methacrylate) copolymer (weight ratio ⅓) and 200 g of methyl cellosolve was heated at 40° C. and dissolved. 1.0 g of 1,6-hexamethylene diisocyanate was added thereto and stirred for 4 hours. The resulting mixture was cooled and then subjected to reprecipitation in water and filtration to obtain a solid product, which was then dried, thus obtaining 35 g of a powder.

Preparation Example 15 of Resin Grains

A mixture of 5 g of 2-methyl-2-oxazoline, 1.0 g of 1,4-tetramethylene-2,2'-bisoxazoline, 0.1 g of methyl p-toluenesulfonate and 20 g of acetonitrile was subjected to sealing polymerization. The resulting reaction product was then subjected to reprecipitation in methanol and a solid product was collected by filtering and dried to obtain 4.1 g of a powder.

The resin obtained in this preparation example is a hydrogel having the following structure:

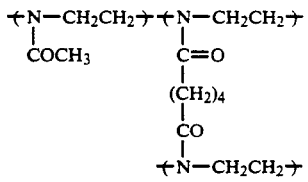

Preparation Example 16 of Resin Grains

A mixed solution of 50 g of 2-methanesulfonylethyl methacrylate, 0.8 g of divinyl succinate and 200 g of dimethylformamide was heated at 70° C. under a nitrogen stream and 1.5 g of A. I. B. N. was added thereto and reacted for 8 hours. The resulting reaction product was subjected to a reprecipitation treatment in hexane and a solid product was collected by filtering and dried to obtain 38 g of a powder.

Synthetic Example 1 of Resin A: Resin A-1

A mixed solution 96 g of benzyl methacrylate, 4 g of thiosalicylic acid and 200 g of toluene was heated at a temperature of 75° C. under a nitrogen stream. 1.0 g of A. I. B. N. was added thereto and reacted for 4 hours, 0.4 g of A. I. B. N. was further added and stirred for 3 hours and 0.2 g of A. I. B. N. was then added and stirred for 3 hours. The resulting copolymer (A-1) has the following structure and a weight average molecular weight $\overline{M}w$ of $6.8\times10^3$:

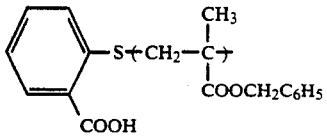

A-1

Synthetic Examples 2 to 13 of Resin A: Resins A-2 to A-13

Synthetic Example 1 was repeated except using monomers shown in the following Table 2 instead of 96 g of benzyl methacrylate, thus obtaining Resins A-2 to A-13. Each of these resins had $\overline{M}w$ of $6.0\times10^3$ to $8\times10^3$.

TABLE 2

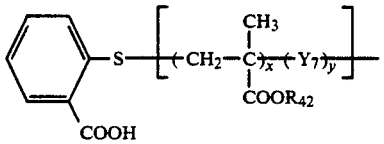

x and y: weight ratio

| Synthetic Example of Resin A | Resin [A] | $R_{42}$ | $-Y_7-$ | x/y |
|---|---|---|---|---|
| 2 | [A-2] | $-C_2H_5$ | — | 96/0 |
| 3 | [A-3] | $-C_6H_5$ | — | 96/0 |
| 4 | [A-4] | 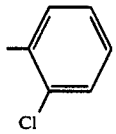 | — | 96/0 |
| 5 | [A-5] | 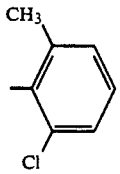 | — | 96/0 |
| 6 | [A-6] | $-CH_3$ | $CH_2-CH(COOCH_3)$ | 86/10 |
| 7 | [A-7] | $-C_2H_5$ | 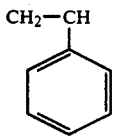 | 86/10 |
| 8 | [A-8] | 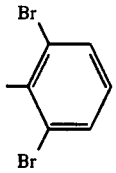 | $-CH_2-C(CH_3)(COOC_2H_5)-$ | 66/30 |
| 9 | [A-9] | 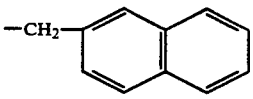 | — | 96/0 |
| 10 | [A-10] | 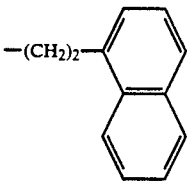 | — | 96/0 |

TABLE 2-continued

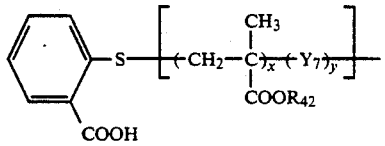

x and y: weight ratio

| Synthetic Example of Resin A | Resin [A] | $R_{42}$ | $-Y_7-$ | x/y |
|---|---|---|---|---|
| 11 | [A-11] | 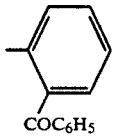 | — | 96/0 |
| 12 | [A-12] | 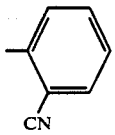 | $-CH_2-C(CH_3)(COOC_2H_5)-$ | 76/20 |
| 13 | [A-13] | $-(CH_2)_2-O-C_6H_5$ | — | 96/0 |

Synthetic Examples 14 to 24 of Resin A: Resins A-14 to A-24

Synthetic Example 1 was repeated except using methacrylates and mercapto compounds as shown in Table 3 instead of 46 g of benzyl methacrylate and 4 g of thiosalicylic acid and using 150 g of toluene and 50 g of isopropanol instead of 200 g of toluene, thus obtaining Resins A-14 to A-24.

TABLE 3

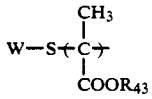

| Synthetic Example of Resin A | Resin A | W— | (amount) | $-R_{43}-$ | (amount) | Mw |
|---|---|---|---|---|---|---|
| 14 | [A-14] | $HOOCCH_2CH_2CH_2-$ | 4 g | $-C_2H_5$ | 96 g | $7.3 \times 10^3$ |
| 15 | [A-15] | $HOOCCH_2-$ | 5 g | $-C_3H_7$ | 95 g | $5.8 \times 10^3$ |
| 16 | [A-16] | $HOOC-CH(HOOC-CH_2)-$ | 5 g | $-CH_2C_6H_5$ | 95 g | $7.5 \times 10^3$ |
| 17 | [A-17] | $HOOCCH_2CH_2-$ | 5.5 g | $-C_6H_5$ | 94.5 g | $6.5 \times 10^3$ |
| 18 | [A-18] | $HOOCCH_2-$ | 4 g | 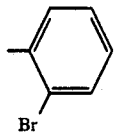 | 96 g | $5.3 \times 10^3$ |
| 19 | [A-19] | $HO-P(=O)(OH)-OCH_2CH_2-$ | 3 g | 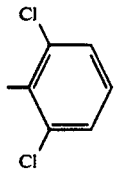 | 97 g | $6.6 \times 10^3$ |
| 20 | [A-20] | $HO_3SCH_2CH_2-$ | 3 g | 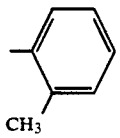 | 97 g | $8.8 \times 10^3$ |

TABLE 3-continued

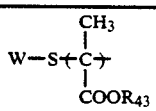

| Synthetic Example of Resin A | Resin A | W— | (amount) | —$R_{43}$— | (amount) | Mw |
|---|---|---|---|---|---|---|
| 21 | [A-21] | 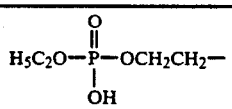 | 4 g | 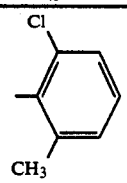 | 97 g | $7.5 \times 10^3$ |
| 22 | [A-22] | 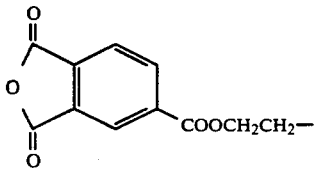 | 7 g | 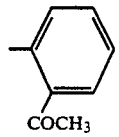 | 96 g | $5.5 \times 10^3$ |
| 23 | [A-23] | 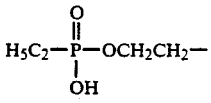 | 6 g | 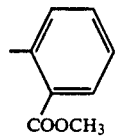 | 94 g | $4.5 \times 10^3$ |
| 24 | [A-24] | 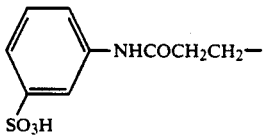 | 4 g | 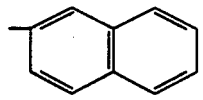 | 96 g | $5.6 \times 10^3$ |

Synthetic Example 25 of Resin A: Resin A-25

A mixed solution of 100 g of 1-naphthyl methacrylate, 150 g of toluene and 50 g of isopropanol was heated at 80° C. under a nitrogen stream. 5.0 g of 4,4'-azobis(4-cyano)valeic acid (hereinafter referred to as A. C. V.) was then added thereto and stirred for 5 hours, 1 g of A. C. V. was further added and stirred for 2 hours and then 1 g of A. C. V. was further added and stirred for 3 hours. The thus resulting polymer has a weight average molecular weight $\overline{M}w$ of $7.5\times10^3$.

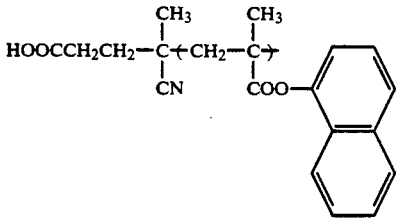

A-25

Synthetic Example 26 of Resin A: Resin A-26

A mixed solution of 50 g of methyl methacrylate and 150 g of methylene chloride was cooled at −20° C. under a nitrogen stream, to which 1.0 g of a 10% hexane solution of 1,1-diphenylhexyllithium, prepared just before it, was added, followed by stirring for 5 hours. Carbon dioxide was introduced thereinto at a flow rate of 10 ml/cc while stirring for 10 minutes, cooling was then stopped and the reaction mixture was stirred and allowed to stand until the temperature became room temperature. The reaction mixture was reprecipitated in a solution of 1000 ml of methanol in which 50 ml of 1N hydrochloric acid had been dissolved and a white powder was collected by filtering. The thus resulting white powder was washed with water and dried under reduced pressure, thus obtaining 18 g of a polymer with $\overline{M}$ of $6.5\times10^3$.

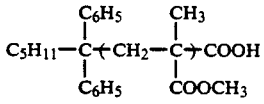

A-26

Synthetic Example 27 of Resin A: Resin A-27

A mixed solution of 95 g of n-butyl methacrylate, 4 g of thioglycolic acid and 200 g of toluene was heated at a temperature of 75° C. 1.0 g of A. C. V. was added thereto and reacted for 6 hours and then 0.4 g of A. I. B. N. was further added and reacted for 3 hours. The thus resulting copolymer had $\overline{M}w$ of $7.8\times10^3$.

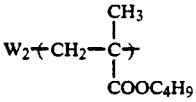

A-27

-continued

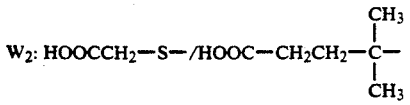

$W_2$: $HOOCCH_2-S-/HOOC-CH_2CH_2-C(CH_3)_2-$

=4/1 (weight ratio)

Preparation Example 1 of Macromonomer M: M-1

A mixed solution of 100 g of methyl methacrylate, 5 g of β-mercaptopropionic acid and 200 g of toluene was heated at a temperature of 75° C. while stirring under a nitrogen stream. 1.0 g of A. I. B. N. was added thereto and reacted for 4 hours, 0.5 g of A. I. B. N. was further added and reacted for 3 hours and then 0.3 g of A. I. B. N. was further added and reacted for 3 hours. 8 g of glycidyl methacrylate, 1.0 g of N,N-dimethyldodecylamine and 0.5 g of t-butylhydroquinone were added to the reaction solution and stirred at a temperature of 100° C. for 12 hours. After cooling, this reaction solution was subjected to reprecipitation in 200 ml of methanol to obtain 82 g of a white powder. The resulting powder had $\overline{M}w$ of 7,800.

M-1

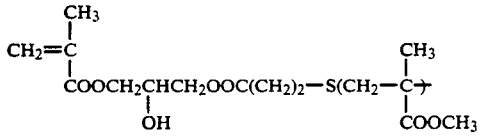

Preparation Example 2 of Macromonomer M: M-2

A mixed solution of 90 g of butyl methacrylate, 10 g of methacrylic acid, 9 g of thioethanol and 200 g of toluene was heated at a temperature of 70° C. while stirring under a nitrogen stream. 1.0 g of A. I. B. N. was added thereto and reacted for 4 hours, 0.5 g of A. I. B. N. was further added and reacted for 3 hours and 0.3 g of A. I. B. N. was then added and reacted for 3 hours. This reaction solution was cooled to room temperature, to which 10 g of 2-carboxyethyl methacrylate was added and a mixed solution of 17.2 g of dicyclohexylcarbodiimide (hereinafter referred to as D. D. C.) and 50 g of methylene chloride was dropwise added for 1 hour. 1.0 g of t-butylhydroquinone was then added and stirred for 4 hours as it was. The precipitated crystal was separated by filtration and the resulting filtrate was subjected to reprecipitation in 2000 ml of methanol. The precipitated oily product was collected by decantation, dissolved in 150 ml of methylene chloride and reprecipitated again in 1000 ml of methanol. The oily product was collected and dried under reduced pressure to obtain 54 g of a polymer with $\overline{M}w$ of 5,800.

M-2

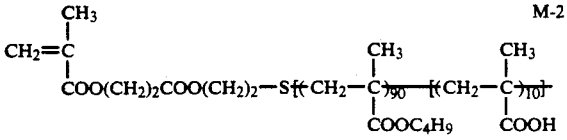

Preparation Example 3 of Macromonomer M: M-3

A mixed solution of 100 g of ethyl methacrylate, 150 g of tetrahydrofuran and 50 g of isopropyl alcohol was heated at a temperature of 75° C. under a nitrogen stream. 4.0 g of A. C. V. was added thereto and reacted for 5 hours and 1.0 g of A. C. V. was further added and reacted for 4 hours. After cooling, the reaction solution was subjected to reprecipitation in 1500 ml of methanol and the oily product was collected by decantation and dried under reduced pressure to obtain 85 g of a dried product. To 50 g of the resulting dried product were added 15 g of glycidyl methacrylate, 1.0 g of N,N-dimethyldodecylamine and 1.0 g of 2,2'-methylenebis-(6-t-butyl-p-cresol) and stirred at a temperature of 100° C. for 15 hours. After cooling, the reaction solution was subjected to reprecipitation in 1000 ml of petroleum ether to obtain a white power with $\overline{M}w$ of 8,500.

M-3

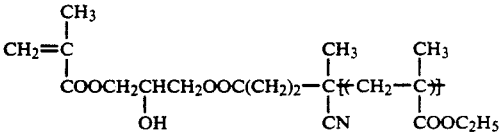

Preparation Example 4 of Macromonomer M: M-4

A mixed solution of 50 g of the oligomer, obtained as an intermediate (oily product collected and dried) in Preparation Example 3 of Macromonomer, 2.2 g of 2-hydroxyethyl methacrylate and 10 g of methylene chloride was stirred at room temperature to which a mixed solution of 40 g of D.D.C., 0.5 g of 3-dimethylaminopyridine and 35 g of methylene chloride was dropwise added, and the mixture was stirred for 3 hours as it was. The precipitated crystal was separated by filtration and the filtrate was subjected to reprecipitation in 1000 ml of methanol two times. The resulting powder was dried under reduced pressure to obtain a polymer with $\overline{M}w$ of 8,000.

M-4

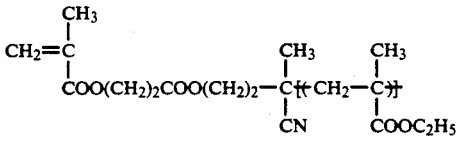

Preparation Example 1 of Resin B: Resin B-1

A mixed solution of 80 g of ethyl methacrylate, 20 g of Macromonomer M-1 and 150 g of toluene was heated at a temperature of 75° C. while stirring under a nitrogen stream. 0.7 g of A. C. V. was added thereto and reacted for 4 hours, 0.3 g of A. C. V. was further added and reacted for 2 hours and 0.3 g of A. C. V. was further added and reacted for 3 hours. After cooling, the mixture was subjected to reprecipitation in 2000 ml of methanol and filtered to obtain 76 g of a white powder with $\overline{M}w$ of $9.8\times10^4$.

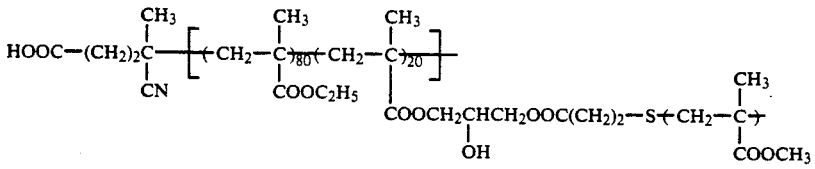

B-1

Preparation Examples 2 to 12 or Resin B: Resins B-2 to B-12

Preparation Example 1 of Resin B-1 was repeated except using the compounds shown in the following Table 4 instead of the methacrylate and Macromonomer M-1, thus obtaining Resins B-2 to B-12 for dispersion stabilization, having e,ovs/M/ w of $8\times10^4$ to $1.2\times10^5$.

referred to as A. B. C. C.) was added thereto and reacted for 4 hours, 0.3 g of A. B. C. C. was further added and reacted for 3 hours and 0.3 g of A. B. C. C. was further added and reacted for 4 hours. The reaction product was cooled, then subjected to reprecipitation in 2000 ml of methanol, separated by filtration and dried to obtain 78 g of a white powder with $\overline{M}w$ of $8.6\times10^4$.

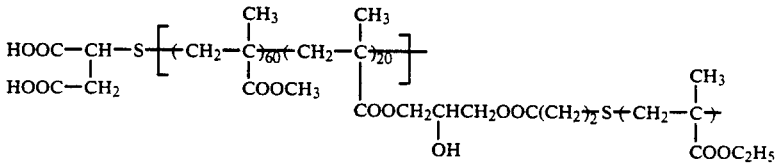

B-13

Preparation Examples 14 to 22 of Resin B: Resins B-14 to B-22

TABLE 4

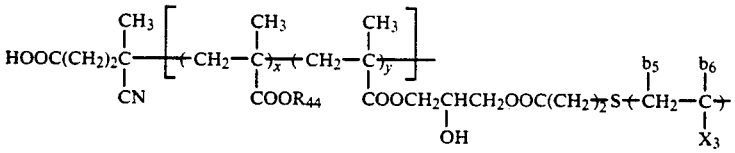

| Preparation Example of Resin B | Resin B | $R_{44}$ | x/y (weight ratio) | $-b_5$ | $-b_6$ | $-X_3$ |
|---|---|---|---|---|---|---|
| 2 | [B-2] | $-C_2H_5$ | 70/30 | —H | $-CH_3$ | $-COOCH_3$ |
| 3 | [B-3] | $-C_4H_9$ | 60/40 | —H | $-CH_3$ | $-COOCH_3$ |
| 4 | [B-4] | $-CH_2C_6H_5$ | 70/30 | —H | $-CH_3$ | $-COOC_3H_7$(i) |
| 5 | [B-5] | $-C_2H_5$ | 60/40 | —H | $-CH_3$ | $-COOC_2H_5$ |
| 6 | [B-6] | $-CH_3$ | 70/30 | —H | $-CH_3$ | $-COOC_4H_9$ |
| 7 | [B-7] | $-CH_3$ | 75/25 | —H | —H | $-COOCH_3$ |
| 8 | [B-8] | $-C_2H_5$ | 80/20 | —H | —H | 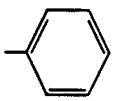 |
| 9 | [B-9] | $-C_4H_9$ | 85/15 | —H | —H | —CN |
| 10 | [B-10] | $-C_6H_5$ | 70/30 | —H | $-CH_3$ | $-COOC_4H_9$ |
| 11 | [B-11] | $-C_2H_5$ | 80/20 | $-CH_3$ | —H | $-COOCH_3$ |
| 12 | [B-12] | $-C_2H_5$ | 70/30 | $-CH_3$ | —H | $-COOC_2H_5$ |

Preparation Example 13 of Resin B: Resin B-13

A mixed solution of 60 g of methyl methacrylate, 40 g of Macromonomer M-3, 0.8 g of thiomalic acid, 100 g of toluene and 50 g of isopropyl alcohol was heated at 80° C. while stirring under a nitrogen stream. 0.5 g of 1,1'-azobis(cyclohexane-1-carbonamide) (hereinafter Preparation Example 13 of Resin B-13 was repeated except using the compounds shown in Table 5 in place of the methacrylate and macromonomer, thus obtaining Resins B-14 to B-22 having $\overline{M}w$ in the range of $8\times10^4$ to $1\times10^5$.

TABLE 5

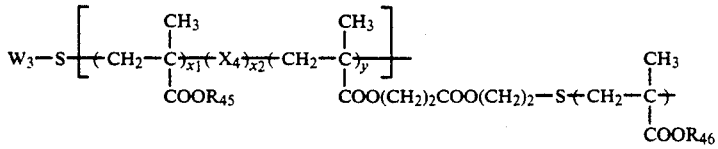

| Preparation Example of Resin B | Resin B | $W_3$ | $R_{45}$ | $X_4$ | $x_1/x_2/y$ | $R_{46}$ |
|---|---|---|---|---|---|---|
| 14 | [B-14] | $HOOCCH_2-$ | $-C_4H_9$ | — | 60/0/40 | $-CH_3$ |
| 15 | [B-15] | 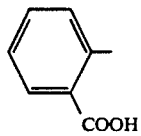 | $-C_2H_5$ | — | 65/0/35 | $-C_2H_5$ |
| 16 | [B-16] | 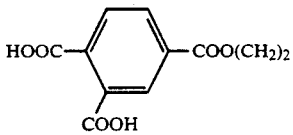 | $-C_2H_5$ | 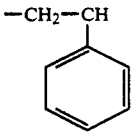 | 50/20/30 | $-C_4H_9$ |
| 17 | [B-17] | 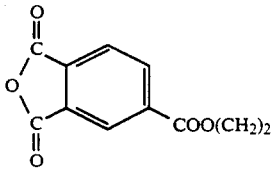 | $-CH_3$ | 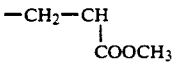 | 50/25/25 | $-C_2H_5$ |
| 18 | [B-18] | $HOCH(HOCH_2)-CH_2-$ | $-CH_3$ | $-CH_2CH(CN)-$ | 40/10/50 | $-C_4H_9$ |
| 19 | [B-19] | $HO-P(=O)(OH)-O(CH_2)_2-$ | $-C_4H_9$ | 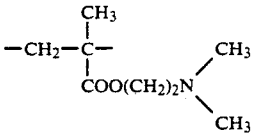 | 50/10/40 | $-CH_3$ |
| 20 | [B-20] | $H_5C_2O-P(=O)(OH)-O(CH_2)_2$ | 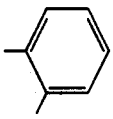 | — | 60/0/40 | $-CH_2C_6H_5$ |
| 21 | [B-21] | 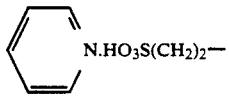 | $-C_4H_9$ | 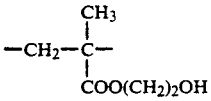 | 50/10/40 | $-CH_3$ |
| 22 | [B-22] | $HO(CH_2)_2-$ | $-C_2H_5$ | 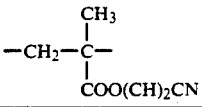 | 60/10/30 | $-C_2H_5$ |

Preparation Examples 23 to 28 of Resins B: Resins B-23 to B-28

Preparation Example 1 of Resin B was repeated except using the azobis compounds shown in the following Table 6 in place of the polymerization initiator, A. C. V., thus obtaining Resins B-23 to B-28 having $\overline{M}w$ in the range of $9\times10^4$ to $1.5\times10^5$.

TABLE 6

$R_{47}-N=N-R_{47}$: Azobis Compound

| Preparation Example of Resin B | Resin B | Azobis Compound: $R_{47}-$ |
|---|---|---|
| 23 | [B-23] | 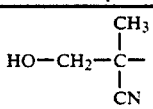 |

TABLE 6-continued

| Preparation Example of Resin B | Resin B | Azobis Compound: $R_{47}$— |
|---|---|---|
| | | $R_{47}$—N=N—$R_{47}$: Azobis Compound |
| 24 | [B-24] | $HO-CH_2CH_2CH_2-C(CH_3)(CN)$ |
| 25 | [B-25] | $HOCH_2CH_2NHCO-C(CH_3)(CN)$ |
| 26 | [B-26] | $(HO-CH_2)_2(H_3C)C-NHCO-C(CH_3)_2$ |
| 27 | [B-27] | 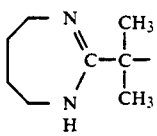 |
| 28 | [B-28] | 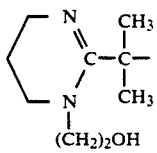 |

TABLE 6-continued

| Preparation Example of Resin B | Resin B | Azobis Compound: $R_{47}$— |
|---|---|---|
| | | $R_{47}$—N=N—$R_{47}$: Azobis Compound |

Preparation Example 29 of Resin B: Resin B-29

A mixed solution containing 90 g of methyl methacrylate, 10 g of Macromonomer M-2 and 150 g of toluene was heated at a temperature of 75° C. while stirring under a nitrogen stream. 0.6 g of A. B. C. C. was added thereto and reacted for 4 hours, 0.4 g of A. B. C. C. was further added and reacted for 3 hours and then 0.3 g of A. I. B. N. was further added and reacted for 4 hours, followed by raising the temperature to 90° C. and reacting for 3 hours. After cooling, the reaction product was subjected to reprecipitation in 2000 ml of methanol, the precipitated viscous product was collected by decantation and dried under reduced pressure, thus obtaining 76 g of a transparent and viscous product with $\overline{M}w$ of $1.1\times10^4$.

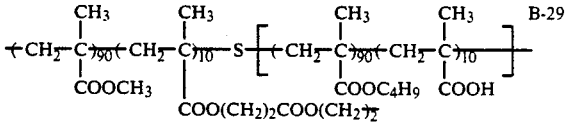

B-29

Preparation Examples 30 to 39 of Resins B: Resins B-30 to B-39

Preparation Example 29 of Resin B was repeated except using the compounds shown in the following Table 7 in place of the methacrylate and macromonomer, thus obtaining Resins B-30 to B-39 having $\overline{M}w$ in the range of $9\times10^4$ to $1.2\times10^5$.

TABLE 7
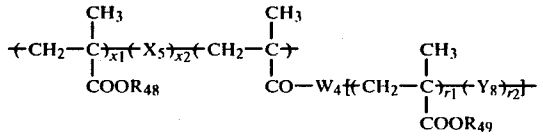
$x_1/x_2/y$ and $r_1/r_2$: weight ratio
| Preparation Example of Resin B | Resin B | $R_{48}$ | $-X_5-$ | $x_1/x_2/y$ | $R_{49}$ | $-Y_8-$ | $r_1/r_2$ |
|---|---|---|---|---|---|---|---|
| 30 | [B-30] | $-C_3H_7$ | — | 85/0/15 | $-CH_3$ | $-CH_2-C(CH_3)(COO(CH_2)_2OH)-$ | 90/10 |
| 31 | [B-31] | $-C_2H_5$ | — | 80/0/20 | $-C_4H_9$ | 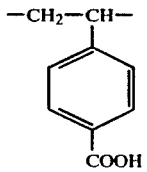 | 95/5 |
| 32 | [B-32] | $-C_2H_5$ | $-CH_2-C(CH_3)(COOH)-$ | 59/1/40 | $-C_2H_5$ | — | 100/0 |
| 33 | [B-33] | $-C_2H_5$ | $-CH_2-CH(COO(CH_2)_2COOH)-$ | 68.5/1.5/30 | $-CH_2C_6H_5$ | — | 100/0 |
| 34 | [B-34] | $-CH_2C_6H_5$ | — | 80/0/20 | $-C_4H_9$ | 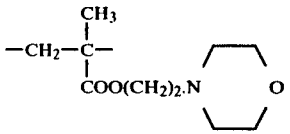 | 90/10 |
| 35 | [B-35] | $-C_3H_7$ | $-CH_2-C(CH_3)(COO(CH_2)_2OCO(CH_2)_3COOH)-$ | 69.2/0.8/30 | $-C_2H_5$ | 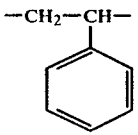 | 80/20 |

TABLE 7-continued
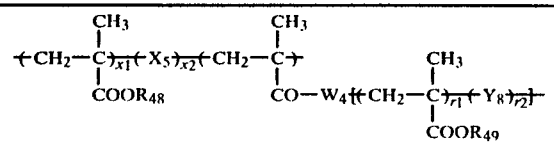
$x_1/x_2/y$ and $r_1/r_2$: weight ratio
| Preparation Example of Resin B | Resin B | $R_{48}$ | $-X_5-$ | $x_1/x_2/y$ | $R_{49}$ | $-Y_8-$ | $r_1/r_2$ |
|---|---|---|---|---|---|---|---|
| 36 | [B-36] | $-C_6H_5$ | 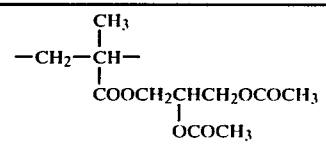 | 80/10/10 | $-C_2H_5$ | 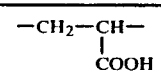 | 95/5 |
| 37 | [B-37] | $-C_2H_5$ | 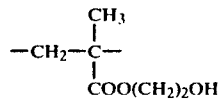 | 72/8/20 | 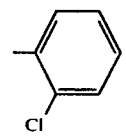 | 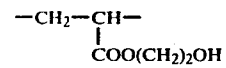 | 85/15 |
| 38 | [B-38] | $-C_2H_5$ | — | 75/0/25 | $-C_2H_5$ | 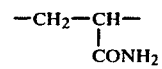 | 90/10 |
| 39 | [B-39] | $-CH_2C_6H_5$ | — | 85/0/15 | $-C_6H_5$ | 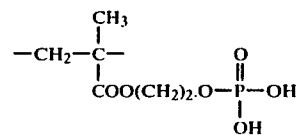 | 95/5 |

Example 1

A mixture of 6 g (as solid content) of Resin A-1 prepared in Preparation Example 1 of Resin A, 34 g (as solid content) of Resin B-1 prepared in Preparation Example 1 of Resin B, 4 g (as solid content) of Hydrophilic Resin Grains prepared in Preparation Example 2 of Resin Grains, 200 g of zinc oxide, 0.018 g of a cyanine dye (A) having the following structure, 0.40 g of tetrahydrophthalic anhydride and 300 g of toluene was ball milled for 2 hours. The thus resulting light-sensitive layer forming dispersion was applied to a paper rendered electrically conductive to give a dry coverage of 22 g/m$^2$ by a wire bar coater, followed by drying at 110° C. for 20 seconds. The thus coated paper was allowed to stand in a dark place at a temperature of 20° C. and a relative humidity of 65% for 24 hours to prepare an electrophotographic light-sensitive material.

Cyanine Dye (A)

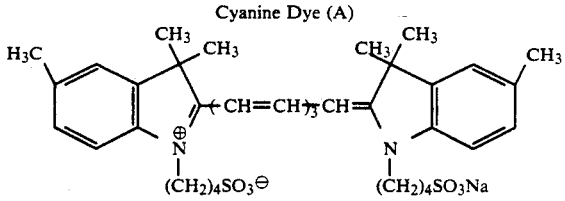

Example 2

Example 1 was repeated except using 34 g of Resin B-29 in place of 34 g of Resin B-1, thus preparing an electrophotographic light-sensitive material.

Comparative Example 1

Example 1 was repeated except using 40 g of only Resin D having the following structure as the binder resin, thus preparing an electrophotographic light-sensitive material D.

Resin D

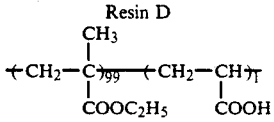

[99:1: by weight]

$\overline{M}$w: 45,000 Tg 46° C.

These light-sensitive material were then subjected to evaluation of the film property (surface smoothness), film strength electrostatic characteristics and reproduced image quality, in particular, under ambient conditions of 30° C. and 80% RH. Furthermore, when using these light-sensitive materials as a master plate for offset printing, the oil-desensitivity of the photoconductive layer in terms of a contact angle of the photoconductive layer with water after oil-desensitization and the printing performance in terms of a stain resistance and printing durability.

The results are shown in Table 8.

TABLE 8

| | Example 1 | Example 2 | Comparative Example 1 |
|---|---|---|---|
| Smoothness of Photoconductive Layer[1)] | 110 | 105 | 80 |
| Strength of Photoconductive Layer[2)] | 94 | 93 | 68 |

TABLE 8-continued

| | Example 1 | Example 2 | Comparative Example 1 |
|---|---|---|---|
| Electrostatic Characteristics[3)] | | | |
| $V_{10}/(-V)$ | | | |
| I (20° C., 65% RH) | 575 | 570 | 445 |
| II (30° C., 80% RH) | 560 | 550 | 220 |
| D. R. R. (%) | | | |
| I | 82 | 80 | 40 |
| II | 78 | 76 | 10 |
| $E_{1/10}$ (erg/m$^2$) | | | |
| I | 18 | 20 | 120 |
| II | 15 | 17 | no photoconductivity |
| Image Quality[4)] | | | |
| I | good | good | disappearance of fine lines and letter, D.M. does not appear. |
| II | good | good | no discrimination of image |
| Contact Angle with Water[5)] (degrees) | less than 10° | less than 10° | 10–20° large dispersion |
| Printing Durability[6)] | no stain even after 10000 prints | no stain even after 10000 prints | background staining from printing start |

The characteristic items described in Table 8 are evaluated as follows:

1) Smoothness of Photoconductive layer

The resulting light-sensitive material was subjected to measurement of its smoothness (sec/cc) under an air volume of 1 cc using a Bekk smoothness tester (manufactured by Kumagaya Riko KK).

2) Mechanical Strength of Photoconductive Layer

The mechanical strength is defined as a film retention ratio (%) obtained by rubbing the surface of the resulting light-sensitive material repeatedly 1000 times with an emery paper (No. 1000) under a load of 55 g/cm$^2$ using a surface property tester of Heidon-14 type (-commercial name-, manufactured by Shinto Kagaku KK) and removing the worn-off powder to give a weight decrease of the light-sensitive layer.

3) Electrostatic Characteristics

Each of the light-sensitive materials was subjected to corona discharge at a voltage of 6 kV for 20 seconds in a dark room at a temperature of 20 ° C. and relative humidity of 65% using a paper analyzer (Paper Analyzer Sp-428 -commercial name- manufactured by Kawaguchi Denki KK) and after allowed to stand for 10 seconds, the surface potential $V_{10}$ was measured. Then, the sample was further allowed to stand in the dark room as it was for 90 seconds to measure the surface potential $V_{100}$, thus obtaining the retention of potential after the dark decay for 60 seconds, i.e., dark decay retention ratio (DRR (%)) represented by $(V_{90}/V_{10})\times 100$ (%). Moreover, the surface of the photoconductive layer was negatively charged to −400 V by corona discharge, then irradiated with monochromatic light of a wavelength of 780 nm and the time required for dark decay of the surface potential ($V_{10}$) to 1/10 was measured to evaluate an exposure quantity $E_{1/10}$(erg/cm$^2$). The ambient conditions for the measurement of the electrostatic characteristics were:

I . . . 20° C., 65% RH
II . . . 30° C., 85% RH

4) Image quality

Each of the light-sensitive materials was allowed to stand for a whole day and night under the following ambient conditions, charged at −5 KV, imagewise exposed rapidly at a pitch of 25 μm and a scanning speed of 300 m/sec under irradiation of 64 erg/cm$^2$ on the surface of the light-sensitive material using a gallium-aluminum-arsenic semiconductor laser (oscillation wavelength: 780 nm) with an output of 2.8 mW as a light source, developed with a liquid developer, ELP-T (-commercial name-, manufactured by Fuji Photo Film Co., Ltd.) and fixed to obtain a reproduced image which was then subjected to visual evaluation of the fog and image quality:

I . . . 20° C., 65% RH
II . . . 30° C., 85% RH

5) Contact Angle with Water

Each of the light-sensitive materials was passed once through an etching processor using an oil-desensitizing solution ELP-EX (-commercial name-, made by Fuji Photo Film Co., Ltd.) to render the surface of the photoconductive layer oil-desensitized. On the thus oil-desensitized surface was placed a drop of 2 μl of distilled water and the contact angle formed between the surface and water was measured by a goniometer.

6) Printing Durability

Each of the light-sensitive materials was subjected to printing plate making under the same conditions as the above described item 4) to form a toner image and then to oil-desensitization under the same conditions as in the above described item 5). The resulting printing plate was mounted, as an offset master, on an offset printing machine (Oliver 52 type -commercial name- manufactured by Sakurai Seisakujo KK) to obtain the printing durability which was defined by the number of prints which could be obtained without forming background stains on the non-image areas of the print and meeting with any problem on the image quality of the image areas by printing. The more the prints, the better the printing durability.

As can be seen from Table 8, in Comparative Example 1 using the prior art resin, the photoconductive layer showed much worse surface smoothness and electrostatic characteristics and when using as an offset master, background stains markedly occurred from the beginning in the print and the contact angle with water was larger, i.e. 20° or more in spite of using the hydrophilic resin grains of the present invention. This is probably due to that interaction of the binder resin with photoconductive zinc oxide is not suitable and aggregation or strong adsorption of the binder resin on zinc oxide grains proceeds so that the oil-desensitization by the oil-desensitizing solution is uneven or insufficient in spite of adding the hydrophilic resin grains according to the present invention.

The light-sensitive material of the present invention, as in Example 1 and Example 2, is excellent in smoothness, film strength and electrostatic characteristics of the photoconductive layer and the contact angle with water after the oil-desensitizing treatment when used as an offset master is small, i.e. at most 10°. Thus, it was found by observation of real prints that it could form a clear image and produced more than 10,000 prints without background stains.

Examples 3 to 9

Example 1 was repeated except using 6 g of each of Resins A shown in the following Table 9, 34 g of each of Resins B shown in Table 9 and 4 g of the hydrophilic resin grains instead of 6 g of Resin A-1, 34 g of Resin B-4 and 4 g of the hydrophilic resin grains and using 0.020 g of a methine dye (B) having the following structure instead of 0.018 g of the cyanine dye (A), thus obtaining light-sensitive materials.

Methine Dye (B)

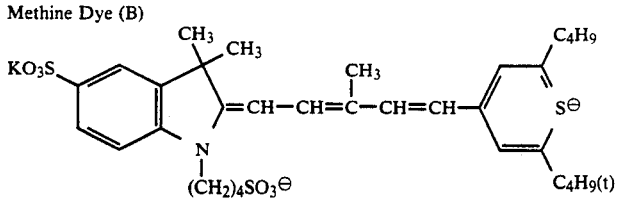

TABLE 9

| Example | Resin A | Resin B | Hydrophilic Resin Grains | Strength of Photo-conductivity | Electrostatic Characteristics (30° C., 80% RH) $V_{10}$ | D.R.R. | $E_{1/10}$ (erg/cm$^2$) | Image Quality (30° C., 80% RH) | Printing Durability |
|---|---|---|---|---|---|---|---|---|---|
| 3 | [A-1] | [B-2] | 1 | 95 | −555 | 78 | 20 | ○ good | more than 10,000 |
| 4 | [A-3] | [B-3] | 3 | 93 | −550 | 80 | 18 | ○ | more than 10,000 |
| 5 | [A-5] | [B-4] | 4 | 94 | −575 | 83 | 18 | ○ | more than 10,000 |
| 6 | [A-8] | [B-10] | 9 | 93 | −560 | 79 | 21 | ○ | more than 10,000 |
| 7 | [A-18] | [B-11] | 15 | 95 | −565 | 81 | 20 | ○ | more than 10,000 |
| 8 | [A-19] | [B-13] | 2 | 96 | −575 | 83 | 20 | ○ | more than 10,000 |

TABLE 9-continued

| Example | Resin A | Resin B | Hydrophilic Resin Grains | Strength of Photo-conductivity | Electrostatic Characteristics (30° C., 80% RH) $V_{10}$ | D.R.R. | $E_{1/10}$ (erg/cm$^2$) | Image Quality (30° C., 80% RH) | Printing Durability |
|---|---|---|---|---|---|---|---|---|---|
| 9 | [A-21] | [B-31] | 6 | 94 | −570 | 81 | 19 | ○ | more than 10,000 |

Each of the light-sensitive material of Examples 3 to 9 exhibited excellent electrostatic characteristics, dark decay retention and photosensitivity and gave a clear reproduced image that is free from occurrence of background stains and disappearance of fine lines even under severer conditions, e.g., high temperature and high humidity (30° C., 80% RH). When printing was carried out using as an offset master plate, 10,000 or more prints of clear image were obtained without background stains.

Example 10

A mixture of 6.5 g (as solid content) of Resin A-25, 33.5 g (as solid content) of Resin B-15, 3.5 g of Hydrophilic Resin Grains prepared in Preparation Example 3 of Resin Grains, 200 g of photoconductive zinc oxide, 0.50 g of Rose Bengal, 0.25 g of bromophenol blue, 0.30 g of uranine, 0.40 g of phthalic anhydride and 240 g of toluene was ball milled for 4 hours. The thus resulting light-sensitive layer forming dispersion was applied to a paper rendered electrically conductive to give a dry coverage of 18 g/m$^2$ by a wire bar coater, followed by heating at 110° C. for 30 seconds and at 120° C. for 2 hours. Then, the coated paper was allowed to stand for 24 hours under conditions of 20° C. and 65% RH to prepare an electrophotographic light-sensitive material.

The resulting light-sensitive material was then subjected to evaluation of various characteristics in an analogous manner to Example 1, thus obtaining a surface smoothness of the photoconductive layer of 120 sec/cc, $V_{10}$ of −560 V, D.R.R. of 93% and $E_{1/10}$ of 10.3 lux·sec. When printing was carried out using as an offset master plate, at least 10,000 prints of clear image were obtained without background stains.

Measurement of the electrostatic characteristics and image quality was carried out as follows:

Electrostatic Characteristics

Each of the light-sensitive materials was subjected to corona discharge at a voltage of 6 kV for 20 seconds in a dark room at a temperature of 20 ° C. and relative humidity of 65% using a paper analyzer (Paper Analyzer Sp-428 -commercial name- manufacture by Kawaguchi Denki KK) and after allowed to stand for 10 seconds, the surface potential $V_{10}$ was measured. Then, the sample was further allowed to stand in the dark room as it was for 60 seconds to measure the surface potential $V_{70}$, thus obtaining the retention of potential after the dark decay for 60 seconds, i.e., dark decay retention ratio (DRR (%)) represented by $(V_{70}/V_{10})\times 100$ (%). Moreover, the surface of the photoconductive layer was negatively charged to −400 V by corona discharge, then irradiated with visible ray at an illumination of 2.0 lux and the time required for dark decay of the surface potential ($V_{10}$) to 1/10 was measured to evaluate an exposure quantity $E_{1/10}$ (lux·sec).

Image quality

Each of the light-sensitive materials was allowed to stand for a whole day and night under the following ambient conditions and a reproduced image was formed thereon using an automatic printing plate making machine ELP-404 V (-commercial name-, made by Fuji Photo Film Co., Ltd., Ltd.) and ELP-T as a toner to visually evaluate the fog and image quality: (I) 20° C., 65% RH and (II) 30° C., 80% RH.

Examples 11 to 22

Example 1 was repeated except using 6.0 g (as solid content) of each of Resins A, 34.0 g (as solid content) of each of Resins B and 4 g (as solid content) of each of Hydrophilic Resin Grains, as shown in Table 10, and 0.20 g of a cyanine dye having the following structure to prepare a light-sensitive material:

Cyanine Dye C

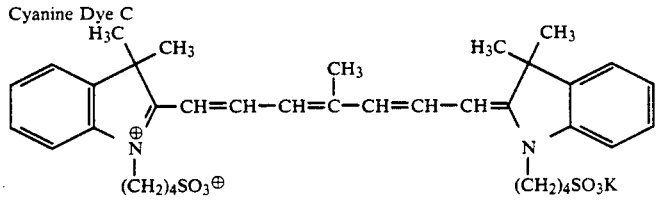

TABLE 10

| Example | Resin A | Resin B | Hydrophilic Resin Grains |
|---|---|---|---|
| 11 | [A-20] | [B-5] | 1 |
| 12 | [A-21] | [B-6] | 2 |
| 13 | [A-22] | [B-7] | 6 |
| 14 | [A-23] | [B-8] | 7 |
| 15 | [A-24] | [B-9] | 8 |
| 16 | [A-9] | [B-13] | 10 |
| 17 | [A-10] | [B-15] | 12 |
| 18 | [A-11] | [B-16] | 13 |
| 19 | [A-16] | [B-17] | 14 |
| 20 | [A-17] | [B-19] | 15 |
| 21 | [A-18] | [B-20] | 16 |
| 22 | [A-19] | [B-21] | 3 |

Each of the light-sensitive materials prepared in Examples 11 to 22 was subjected measurement of the electrostatic characteristics and printing property in an analogous manner to Example 1, thus exhibiting excellent electrostatic characteristics, dark decay retention and photosensitivity and giving a clear reproduced image that is free from occurrence of background stains and disappearance of fine lines even under severer conditions, e.g., high temperature and high humidity (30° C., 80% RH). When printing was carried out using as an offset master plate, 10,000 or more prints of clear image were obtained without background stains on a non-image area.

Examples 23 to 30

Example 10 was repeated except using 6.5 g (as solid content) of each of Resins A and 33.5 g (as solid content) of each of Resins B as shown in the following Table 11 instead of 6.5 g of Resin A-25 and 33.5 g of Resin B-15 in Example 10, thus obtaining a light-sensitive material.

TABLE 11

| Example | Resin A | Resin B |
|---|---|---|
| 23 | [A-2] | [B-1] |
| 24 | [A-7] | [B-4] |
| 25 | [A-8] | [B-15] |
| 26 | [A-13] | [B-29] |
| 27 | [A-14] | [B-32] |
| 28 | [A-15] | [B-33] |
| 29 | [A-26] | [B-35] |
| 30 | [A-27] | [B-36] |

Each of the light-sensitive materials prepared in Examples 23 to 30 was subjected to plate making using ELP-404V to obtain a clear reproduced image. When printing was carried out using as an offset master plate, 10,000 or more prints of clear image were obtained without background stains.

According to the present invention, there can be provided a lithographic printing plate precursor having a very excellent printing property. Furthermore, the present invention can provide a lithographic printing plate, whereby the hydrophilic resin grains do not cause background stains of a non-image area and a large number of prints can be obtained In addition, the electrophotographic lithographic printing precursor can exhibit very excellent electrostatic characteristics in spite of that a spectral sensitizing dye completely differ in chemical structure and in particular, can give a very excellent reproduced image in the scanning exposure system by a semiconductor laser.

What is claimed is:

1. An electrophotographic lithographic printing plate precursor comprising a conductive support having provided thereon at least one photoconductive layer containing photoconductive zinc oxide and a binder resin, wherein said photoconductive layer contains hydrophilic resin grains having an average grain diameter the same as or smaller than the maximum grain diameter of said photoconductive zinc oxide grains and said binder resin comprises at least one of the following Resin A and at least one of the following Resin B:

(a) Resin A: a resin having a weight average molecular weight of $1\times10^3$ to $2\times10^4$, containing at least 30% by weight of recurring units represented by the following formula (I) as polymeric components and having at least one polar group bonded to one end of the polymer main chain, selected from the group consisting of $-PO_3H_2$, $-SO_3H$, $-COOH$, $-OH$.

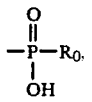

wherein $R_0$ is a hydrocarbon group or $-OR_0'$, wherein $R_0'$ represents a hydrocarbon group, and $R_0$ further representing cyclic acid anhydride-containing groups:

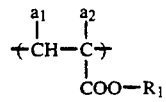

(I)

in which $a_1$ and $a_2$ each, individually, represents a hydrogen atom, halogen atoms, a cyano group and hydrocarbon groups and $R_1$ represents a hydrocarbon group; and (b) Resin B: a resin consisting of a copolymer having a weight average molecular weight of at least $3\times10^4$ and obtained from a monofunctional macromonomer and a monomer, said monofunctional macromonomer having a polymerizable double bond group represented by the following formula (IIc) bonded to only one end of a polymer main chain containing at least one of recurring units represented by the following formulae (IIa) and (IIb) as polymeric components and having a weight average molecular weight of at most $2\times10^4$ and said monomer represented by the following formula (III):

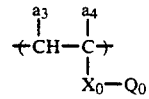

(IIa)

in which $X_0$ represents —COO—, —OCO—, $-(CH_2)_l-OCO-$, $-(CH_2)_l-COO-$, —O—, —CONHCOO—, —CONHCONH—, $-SO_2-$, —CO—,

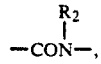

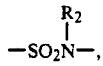

wherein $R_2$ represents a hydrogen atom or a hydrocarbon group or

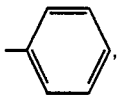

l being an integer of 1 to 3. $Q_0$ represents an aliphatic group containing 1 to 18 carbon atoms or an aromatic group containing 6 to 12 carbon atoms and $a_3$ and $a_4$ each, individually has the same meaning as $a_1$ and $a_2$:

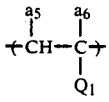

(IIb)

in which $Q_1$ represents —CN, $-CONH_2$ or

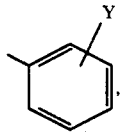

Y represents a hydrogen atom, a halogen atom, an alkoxy group or —$COOZ_0$, wherein $Z_0$ represents an alkyl group, an aralkyl group or an aryl group, and $a_5$ and $a_6$ each, individually, has the same meaning as $a_1$ and $a_2$ of formula (I);

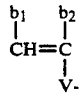

(IIc)

in which V represents the same meaning as $X_0$ in formula (IIa), $b_1$ and $b_2$ each, individually, represents a hydrogen atom, halogen atoms, a cyano group, hydrocarbon groups, —$COOR_3$ or —$COOR_3$ via hydrocarbon groups, wherein $R_3$ represents a hydrogen atom or an optionally substituted hydrocarbon group:

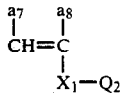

(III)

in which $X_1$ has the same meaning as $X_0$ in formula (IIa) or V in formula (IIc), $Q_2$ has the same meaning as $Q_0$ in formula (IIa) and $a_7$ and $a_8$ each, individually, has the same meaning as $a_1$ and $a_2$ in formula (I).

2. A electrophotographic lithographic printing plate precursor as claimed in claim 1, wherein the recurring unit represented by formula (I) of Resin A is an aryl group-containing methacrylate component represented by at least one of formulae (Ia) and (Ib) as described below:

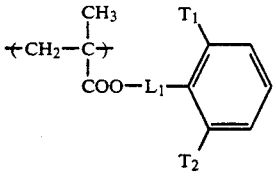

(Ia)

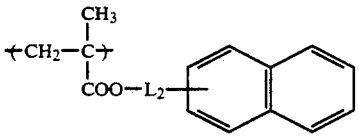

(Ib)

in which $T_1$ and $T_2$ each represents independently a hydrogen atom, hydrocarbon groups containing 1 to 10 carbon atoms, a chlorine atom, a bromine atom, —$COR_4$ or —$COOR_4$, wherein $R_4$ represents a hydrocarbon group containing 1 to 10 carbon atoms, both $T_1$ and $T_2$ not being hydrogen atom at the same time, and $L_1$ and $L_2$ each represents direct bonds for bonding —COO— and benzene ring or bonding groups containing 1 to 4 bonding atoms.

3. An electrophotographic lithographic printing plate precursor as claimed in claim 1, wherein Resin B is a resin having at least one polar group selected from the group consisting of —$PO_3H_2$, —$SO_3H$, —COOH, —OH, —SH,

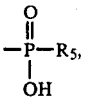

wherein $R_5$ represents a hydrocarbon group or —$OR_5'$, wherein $R_5'$ represents a hydrocarbon group, $R_5$ further representing cyclic acid anhydride-containing groups, —CHO, —$CONH_2$, —$SO_2NH_2$ and

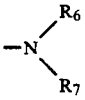

wherein $R_6$ and $R_7$ each, individually, represents a hydrogen atom or hydrocarbon groups, bonded to only one end of at least one polymer main chain.

4. An electrophotographic lithographic printing plate precursor as claimed in claim 1, wherein the hydrophilic resin has a high order network structure.

5. An electrophotographic lithographic printing plate precursor as claimed in claim 4, wherein the high order network structure is formed by cross-linking the polymer molecule chains of a polymer comprising hydrophilic polymeric components.

6. An electrophotographic lithographic printing plate precursor as claimed in claim 5, wherein the cross-linking is carried out by the use of a cross-linking agent or hardening agent.

7. An electrophotographic lithographic printing plate precursor as claimed in claim 5, wherein the cross-linking is carried out by polymerizing a monomer corresponding to the hydrophilic polymeric component in the presence of a multi-functional monomer or oligomer containing at least two polymerizable functional groups.

8. An electrophotographic lithographic printing plate precursor as claimed in claim 5, wherein the cross-linking is carried out by polymerizing or high molecular reaction of a polymer having reactive groups with the hydrophilic polymerizable component.

9. An electrophotographic lithographic printing plate precursor as claimed in claim 4, wherein the hydrophilic resin has a solubility of at most 80% by weight in water.

10. An electrophotographic lithographic printing plate precursor as claimed in claim 1, wherein the hydrophilic resin grains have a maximum grain diameter of at most 10 μm and an average grain diameter of at most 1 μm.

11. An electrophotographic lithographic printing plate precursor as claimed in claim 1, wherein the hydrophilic resin grains are in a proportion of 0.1 to 5 parts by weight to 100 parts by weight of the photoconductive zinc oxide.

12. An electrophotographic lithographic printing plate precursor as claimed in claim 1, wherein the hydrophilic resin is selected from the group consisting of synthetic hydrophilic resins and natural hydrophilic resins.

13. An electrophotographic lithographic printing plate precursor as claimed in claim 1, wherein the hydrophilic resin consists of a homopolymer or copolymer comprising a polymeric component having at least one hydrophilic group in the polymer side chain, the polymeric component being in a proportion of 20 to 100% by weight to the resin.

14. An electrophotographic lithographic printing plate precursor as claimed in claim 1, wherein Resins A and B are used in a Resin A to Resin B ratio of 5 to 80 to 95 to 20 by weight.

15. An electrophotographic lithographic printing plate precursor as claimed in claim 1, wherein the binder resin is in a proportion of 10 to 100 parts by weight to 100 parts by weight of the photoconductive zinc oxide.

16. An electrophotographic lithographic printing plate precursor as claimed in claim 1, wherein the photoconductive layer further contains at least one dye as a spectral sensitizer.

* * * * *